US011846147B2

(12) United States Patent
McInally

(10) Patent No.: US 11,846,147 B2
(45) Date of Patent: Dec. 19, 2023

(54) DEVICE FOR HYDRAULICALLY OPERATING A DRIVE WHEEL OF A WELLBORE TRACTOR, E.G. A MOTOR, AND RELATED TRACTOR, WELLBORE STRING, AND METHOD

(71) Applicant: Altus Intervention (Technologies) AS, Stavanger (NO)

(72) Inventor: Gerald McInally, Bryne (NO)

(73) Assignee: Altus Intervention (Technologies) AS, Stavanger (NO)

( * ) Notice: Subject to any disclaimer, the term of this patent is extended or adjusted under 35 U.S.C. 154(b) by 450 days.

(21) Appl. No.: 16/973,907

(22) PCT Filed: Jun. 27, 2019

(86) PCT No.: PCT/NO2019/050136
§ 371 (c)(1),
(2) Date: Dec. 10, 2020

(87) PCT Pub. No.: WO2020/005075
PCT Pub. Date: Jan. 2, 2020

(65) Prior Publication Data

US 2021/0246745 A1 Aug. 12, 2021

(30) Foreign Application Priority Data

Jun. 28, 2018 (NO) ..... 20180911

(51) Int. Cl.
*E21B 23/00* (2006.01)
*F03C 1/047* (2006.01)
(Continued)

(52) U.S. Cl.
CPC ..... *E21B 23/001* (2020.05); *F03C 1/047* (2013.01); *F03C 1/0472* (2013.01); *F04B 1/063* (2013.01); *F04B 1/1071* (2013.01); *E21B 4/18* (2013.01)

(58) Field of Classification Search
CPC ..... E21B 23/001; E21B 4/18; F03C 1/047; F03C 1/0472; F04B 1/063; F04B 1/1071
See application file for complete search history.

(56) References Cited

U.S. PATENT DOCUMENTS 5,391,059 A * 2/1995 Hallund ..... F04B 1/0408 92/72
9,435,167 B2 9/2016 Hallundbæk
(Continued)

FOREIGN PATENT DOCUMENTS

EP 2505763 A1 10/2012
EP 2505764 A1 10/2012
(Continued)

*Primary Examiner* — Robert E Fuller
(74) *Attorney, Agent, or Firm* — GableGotwals

(57) ABSTRACT

A device for hydraulically operating a drive wheel of a wellbore tractor has, in certain embodiments, at least one cam and a rotatable assembly arranged to be rotatable with respect to the cam about an axis of rotation. The rotatable assembly has at least one piston. The device also has a chamber and at least one supply port for supplying hydraulic fluid from the chamber to the piston for energizing the piston, the supply port being arranged to be moved between first and second positions relative to the cam. In the first position, the piston can connect to the supply port and be energized to impart force against the cam for producing forward rotation of the assembly. In the second position, the piston can connect to the supply port and be energized to impart force against the cam for producing reverse rotation of the assembly. Related distributor assembly, wellbore tractor, and method are also described.

42 Claims, 17 Drawing Sheets

(51) Int. Cl.

| | |
|---|---|
| ***F04B 1/063*** | (2020.01) |
| ***F04B 1/1071*** | (2020.01) |
| ***E21B 4/18*** | (2006.01) |

(56) References Cited

U.S. PATENT DOCUMENTS

| | | | |
|---|---|---|---|
| 2014/0014365 | A1 | 1/2014 | Hallundbæk |
| 2016/0177719 | A1 | 6/2016 | Offenburger et al. |

FOREIGN PATENT DOCUMENTS

| | | | |
|---|---|---|---|
| EP | 2505765 | A1 | 10/2012 |
| EP | 2770158 | A1 | 8/2014 |
| WO | 9210677 | A1 | 6/1992 |

* cited by examiner

DEVICE FOR HYDRAULICALLY OPERATING A DRIVE WHEEL OF A WELLBORE TRACTOR, E.G. A MOTOR, AND RELATED TRACTOR, WELLBORE STRING, AND METHOD

CROSS-REFERENCE TO RELATED APPLICATIONS

This United States application is the National Phase of PCT Application No. PCT/NO2019/050136 filed 27 Jun. 2019, which claims priority to Norwegian Patent Application No. 20180911 filed 28 Jun. 2018, each of which is incorporated herein by reference.

TECHNICAL FIELD

The present invention relates to the field of tractors for use in wellbores, and in particular to a device for hydraulically operating a drive wheel of a wellbore tractor.

BACKGROUND

In the oil and gas exploration and production industry, access to wellbores may be facilitated using wellbore tractors. For certain operations, e.g. in intervention operations in a well, a tool string can be conveniently deployed from the surface, lowered through the wellbore, and retrieved back to the surface on a wireline. The wireline is typically spooled out from a vessel or other platform above the top of the wellbore. In order to advance the tool string through the wellbore, in particular in deviated or horizontal sections of the wellbore, a tractor may also be coupled to the wireline. Such a tractor is often termed a "wireline tractor", and can be used to help to drive the tool string along the wellbore.

Wireline tractors of this kind typically have drive wheels mounted on arms which are extracted from a body of the tractor for urging the drive wheels against a surrounding wall of the wellbore. Pressure against the wall can facilitate wheel traction as the wheels are turned. Variants are known where the tractor has drive wheels on several arms spaced along the body to enhance the overall traction obtained from the tractor. For instance, several drive sections may be included in the tractor, each comprising one or more drive wheels mounted on respective arms.

Some designs for wireline tractors are based on hydraulic operation of the drive wheels, using a hydraulic radial piston motor arranged within the drive wheel. Hydraulic radial piston motors typically include an arrangement of linear pistons which are spaced apart from one another around a centre and which operate to extend or retract in a radial direction from the centre. The pistons may operate in a predetermined sequence to engage a cam ring, thereby generating torque. When embodied in a tractor, the pistons may be mounted on a body which rotates relative to the cam ring as the pistons operate. The drive wheel can be connected to the rotating body directly or e.g. by planetary gears so that torque is transmitted from the body to the wheel.

An example radial piston motor is described in international patent publication number WO92/10677.

In wellbore operations, there may be a need for applying a drive force to move the tool string into the wellbore, e.g. to access far reaches of the wellbore, or out of the wellbore, e.g. to pull out equipment from the wellbore. Current designs incorporating hydraulic piston motors inside the drive wheel of wellbore tractors are generally tuned for utilization of available space, and in small diameter tractors, limited available space for the supply and return of hydraulic fluid can be a constraint on the drive power attainable. Generally, the supply and return paths of hydraulic fluid in existing solutions cannot simply be reversed. Current drive wheel solutions based on radial piston motors can suffer from lack of versatility and/or convenience. The designs can also involve complexity and moving parts through which seals between parts can be subjected to friction and wear and potential for undesired leakages.

SUMMARY OF THE INVENTION

According to a first aspect of the invention there is provided a device for hydraulically operating a drive wheel of a wellbore tractor, the device comprising: at least one cam; a rotatable assembly arranged to be rotatable with respect to the cam about an axis of rotation, the assembly comprising at least one piston; a chamber; and at least one supply port for supplying hydraulic fluid from the chamber to the piston for energizing the piston, the supply port being arranged to be moved between first and second positions relative to the cam; wherein, in the first position, the piston can connect to the supply port and be energized to impart force against the cam for producing forward rotation of the assembly, and in the second position, the piston can connect to the supply port and be energized to impart force against the cam for producing reverse rotation of the assembly.

Changing the position of the supply port into the first or second positions can thus advantageously be deployed to change the direction of rotation produced by the device without having to resort to other means. For example, large-scale reengineering of the actuation means or hydraulic fluid routes to and from the drive wheel and the tractor wheel arm may be avoidable.

In the first position, the rotatable assembly can, upon rotation, obtain communication between the port and the piston in at least one part of its rotation cycle for energizing the piston to impart a force against the cam for generating forward rotation of the assembly. In the second position, the rotatable assembly can, upon rotation, obtain communication between the port and the piston in at least one other part of its rotation cycle for energizing the piston to impart a force against the cam for generating reverse rotation of the assembly about the axis.

The rotatable assembly may typically comprise a plurality of pistons and the device may further comprise a plurality of supply ports for supplying hydraulic fluid from the chamber to respective ones of the pistons. The use of multiple pistons can facilitate smooth continuous rotation of the rotatable assembly.

The device may typically further comprise a distributor. The distributor may be a distributor for distributing hydraulic fluid, e.g. hydraulic oil, between or among the pistons. The distributor may comprise the supply port or the plurality of supply ports. The distributor may comprise a part such as a sleeve or a ring, and the supply port may comprise an opening through a wall of the part e.g. the sleeve or the ring. The distributor may further comprise the chamber.

More specifically, the distributor may comprise a distributor assembly having first and second parts, being typically inner and outer parts respectively. The inner and outer parts may define the chamber therebetween. Either the outer part or the inner part may include the supply port or plurality of supply ports. The outer part may be disposed around the inner part. Either or both of the outer and inner parts may be in the form of a ring or a sleeve. The supply port or ports may be a radial port or ports extending through a wall of the sleeve or ring. The supply port or ports may be spaced apart circumferentially around the sleeve or ring. The chamber may typically comprise an annular chamber, e.g. between the inner and outer parts.

The device may comprise part of an arm of the tractor. The rotatable assembly may be supported on the arm. The arm or part thereof may be configured to define an annular space for receiving the rotatable assembly or portion thereof in the annular space. The rotatable assembly may have generally an annular shape.

The drive wheel is typically to be mounted at an end of the arm of the wellbore tractor. Preferably the cam, and the distributor i.e. at least once the supply port of the distributor is configured in the first or the second position, are positionally fixed or stationary with respect to the arm or part thereof, and the rotatable assembly is preferably rotatable with respect to both the distributor and the cam.

The piston or pistons may be operable to extend linearly, and radially away from the axis of rotation.

The cam may extend circumferentially around the rotatable assembly. The cam may comprise a cam ring. The distributor may comprise a distributor ring or sleeve including the at least one supply port through a material of the ring or sleeve.

The cam ring and the distributor ring or sleeve may typically be arranged concentrically around the axis of rotation. The distributor ring may be arranged disposed at a different position along the axis from the cam ring. The rotational assembly may comprise an annular body portion which may also typically be arranged concentric about the axis. The annular portion may be disposed on an inside or outside of the distributor ring.

The cam may comprise a profile extending circumferentially around the rotatable assembly. The profile may have one or more surface sections forming an acute angle to an axis of linear extension of the piston or pistons of the rotatable assembly. The profile may be a wave profile. The wave profile may comprise crests and troughs. In advantageous embodiments, the rotatable assembly may comprise eight pistons arranged to produce linear extension radially with respect to the axis of rotation. The pistons may be distributed angularly in the assembly about the axis of rotation at substantially equal angular intervals. In embodiments with the eight pistons, the wave profile may advantageously comprise six crests and six troughs. In general, 2, 4, 6, 8, or 10 pistons may be employed. One or more pairs of the pistons, i.e. diametrically opposed in the assembly, may cooperate to be activated simultaneously to impart forces against the cam to produce the rotation in the reverse or forward direction.

In the first position of the supply port relative to the cam, the at least one piston may be energized with linear extension to impart force against at least one first surface section of the cam. The first surface section may be inclined with respect to the direction of linear extension of the piston for producing the forward rotation. In the second position of the supply port relative to the cam, the at least one piston may be energized with linear extension to impart force against at least one second surface section of the cam. The second surface section may be inclined with respect to the direction of linear extension of the piston in an opposite sense to the incline of the at least one first surface section, for producing the reverse rotation.

The device may further comprise a coupling for transmitting rotation to the drive wheel in correspondence with the reverse or forward rotation of the rotatable assembly. The device may further comprise a gear arrangement for coupling the drive wheel to the rotatable assembly. The gear arrangement may be a planetary gear arrangement. The gear arrangement may comprise an inner sun gear attached to the rotatable assembly, an outer ring gear to be attached to the wheel and planet gears arranged between the sun gear and the ring gear.

The device may further comprise the drive wheel, which may define an enclosure for containing return hydraulic fluid from the piston or pistons therewithin. The device may further comprise a drain path for communicating the return hydraulic fluid through open space in the enclosure to low pressure tank.

The device may be or may comprise a radial piston motor, e.g. a hydraulic radial piston motor.

The device may further comprise a boss or pin. The assembly may be rotatable about the boss or pin. Accordingly, the axis of rotation may be an axis through the boss or pin. The axis of rotation may extend through the assembly or through an aperture in the assembly. The boss or pin may include any of the port, the chamber, and/or the distributor including the port and the chamber. The boss or pin may protrude from a surface of the chassis. The boss or pin may protrude into an enclosure of the device. The assembly may have an aperture such that the assembly fits over the boss or pin. The boss or pin may protrude into the aperture of the assembly. The supply port or ports may supply hydraulic fluid radially away from the boss. The assembly may include an annular portion extending circumferentially around an outside of the boss and/or the part including the supply port. The boss may be a cylindrical structure which the rotatable assembly may bear against, e.g. via one or more bearings. Thus, the rotatable assembly may spin or rotate freely on the boss or pin.

In some embodiments, the supply port or ports may be disposed on a separate part disposed around an outside of the boss. In such an embodiment, the supply ports may supply hydraulic fluid radially toward the boss. In such an embodiment, the rotatable assembly may comprise an annular portion disposed in an annulus between the boss and the part comprising the supply parts. Thus, the annular portion of the rotatable assembly in such an embodiment may be positioned on an inside of the part comprising the supply ports.

The device may comprise a formation for receiving and guiding return hydraulic fluid along a drain path toward low pressure tank. Thus, when a piston of the rotatable assembly have particular angular alignment with the formation, return fluid may be expelled from the piston and communicated away from the piston via the formation. The distributor may include the formation, e.g. on a sleeve or ring part of the distributor, and may comprise e.g. a notch, axial groove or channel, slot, port or the like. Return fluid may travel on the drain path through an opening of the formation into an open space of the enclosure of the wheel. The return fluid may further travel on the drain path from the space of the enclosure of the wheel and through a drain line or conduit in the arm to the low pressure tank.

According to a second aspect of the invention, there is provided a distributor, e.g. a distributor assembly, for distributing hydraulic fluid in a device for operating a drive wheel of a wellbore tractors, such as the device according to the first aspect of the invention, the device comprising at least one cam and a rotatable assembly rotatable about an axis of rotation relative to the cam, the distributor comprising: an inner part; an outer part arranged around the inner part; and a chamber between the inner and outer parts; either the inner part or the outer part comprising at least one supply port for transmitting hydraulic fluid therethrough from the chamber to a connected piston of the rotatable assembly for energizing the piston; wherein the inner or outer part is movable with respect to the other of inner and outer parts between first and second positions, for forward rotation of the rotatable assembly when in the first position and reverse rotation of the rotatable assembly when in the second position.

The relative movement of the inner and outer parts may determine the location of the port or ports. The inner or outer part may be movable in relation to the other of the inner and outer parts for locating the port in the first position corresponding to a first surface section of the cam for producing forward rotation of the rotatable assembly, in a second position corresponding to a second surface section of the cam for producing reverse rotation of the rotatable assembly about the axis.

The outer or the inner part may be lockable to obtain a fixed relationship with respect to the other of the inner and outer parts in either the first or the second position.

The distributor assembly may further comprise a locking device, e.g. releasable locking device, for locking the inner or the outer part in fixed relationship with respect to the other of the inner and outer parts in the first or second position. The locking device may comprise a locking ring and a fastener for fastening the locking ring to either the inner or outer part, so that the locking ring can prevent relative movement between the inner and outer parts when in the first or the second position. The locking device and/or fastener may be releasable to release the inner part from the outer part, or vice versa, to allow movement of the inner part relative to the outer part, or vice versa, between the first and second positions.

In certain embodiments, the outer part may comprise a ring or sleeve around the inner part. The inner part may comprise a boss. The outer part may be slidably disposed around the inner part for slidably rotating the outer part circumferentially around the inner part between the first and second positions. The distributor assembly may further comprise a pair of seals extending around the inner part. The annular chamber may be defined between the seals. The supply ports may comprise an opening through a wall of the outer part for communicating with the chamber. The outer part may be arranged to be releasable from locked configuration with the inner part, e.g. by hand. The outer part may be arranged to be rotatably movable from the first position to the second position relative to the inner part, e.g. by hand.

In other embodiments, the inner part may comprise a ring or sleeve. The outer part may be part of an arm of a tractor. The inner part may be part of an arm of a tractor. The inner part may be slidably disposed within the outer part for slidably rotating the inner part circumferentially within the outer part between the first and second positions. The supply ports may comprise an opening through a wall of the inner part for communicating with the chamber. The inner part may be arranged to be releasable from locked configuration with the outer part, e.g. by hand. The inner part may be arranged to be rotatably movable, e.g. slidably, from the first position to the second position relative to the outer part, e.g. by hand. In these other embodiments also, the distributor assembly may further comprise a pair of seals extending around the inner part. The annular chamber may be defined between the seals.

At least one seal, e.g. the pair of seals, may be disposed between the inner and outer parts. The seal, or either or both of the pair of seals, may be a sliding seal, and/or a ring seal and/or an elastomer seal. The inner or outer part may be arranged to slidably bear against the seal or either or both of the pair of seals. This may allow rotatable circumferential relative movement of the parts between the first and second positions while the seal or seals can continue to function for containing the hydraulic fluid in the chamber, such hydraulic fluid to be distributed to the supply ports.

More generally, either or both of the inner and outer parts may be adapted to be electrically or hydraulically actuable for rotating the inner part relative to the outer part, or vice versa, between the first position and the second position.

The part comprising the ports, e.g. the inner or outer part, may include at least one formation for defining a drain path away for fluid expelled from the piston in part of the rotation cycle of the assembly. The part may comprise formations for draining away return fluid from the pistons that are interspersed between the supply ports around a circumference of the part.

The formation(s) may comprise for instance a groove or recess, e.g. in a surface of the part e.g. in a wall of the part, or a notch, or the like. The groove, recess or notch may provide a flow conduit, gap, passageway or the like, in a region between the rotatable assembly and the part, for draining return fluid from the piston away from the rotatable assembly.

According to a third aspect of the invention, there is provided a wellbore tractor including the device of the first aspect or the distributor of the second aspect.

The device may be provided in an extractable arm of the tractor. The tractor may comprise at least one drive wheel and the rotatable assembly of the device may be coupled to the drive wheel to produce forward or reverse rotation of the drive wheel in dependence upon the rotation of the rotatable assembly.

According to a fourth aspect of the invention, there is provided a wellbore string including at least one tractor section, wherein the tractor section includes a drive wheel mounted on an end of an arm which is extractable from a body of the tractor section, the tractor section further including a device according to the first aspect for operating the drive wheel.

The wellbore string may include a plurality of tractor sections respectively including at least one drive wheel mounted on an end of an arm which may be extractable from a body of the tractor section, wherein at least one of the tractor sections may have a device according to the first aspect of the invention, in which the at least one port may be set in the first position for operating a corresponding drive wheel in a forward direction, and at least one other of the tractor sections may have a device according to the first aspect of the invention to in which the at least one port may be set in the second position for operating another corresponding drive wheel in a reverse direction. The wellbore string may typically be configured to be coupled to a wireline. The wellbore string may include at least one well intervention tool. The tractor sections may be tractor drive sections. The wellbore tractor may be a wireline tractor.

According to a fifth aspect of the invention, there is provided a method of operating a tractor in a wellbore, the tractor having at least one section comprising at least one drive wheel mounted on an end of an arm which may be extractable from a body of the section, and the arm including a device according to the first aspect of the invention, the method comprising the steps of:

extracting the arm to push the drive wheel against a surrounding wall of the wellbore;

supplying hydraulic fluid to the chamber of the device to generate rotation of the tractor wheel in either the forward or reverse direction corresponding to the position of the ports, the hydraulic fluid supplied to the chamber through the arm.

The method may be a method of configuring and operating the tractor in the wellbore. The method may comprise operating a hydraulic pump to deliver supply the hydraulic fluid to the chamber. The tractor may be included in a wellbore string, and the wellbore string may include the pump in a section of the wellbore string. The pump may be electrically operated. The wellbore tractor may be connected to a wireline. The supply of fluid or electrical power may be supplied to the tractor sections and/or other sections wellbore string through the wireline.

The method may comprise moving the part comprising at least one port between the first position and the second position relative to the cam to switch the direction of rotation of the drive wheel. The method may comprise hydraulically or electrically actuating the part to move it, e.g. using fluid and/or electrical power supplied from the surface.

According to a sixth aspect of the invention, there is provided a method of configuring a wellbore tractor, the tractor having at least one section which comprises at least one device according to the first aspect of the invention, the method comprising the step of moving the port between the first position and the second position to set the port in either the first position for generating forward motion of the drive wheel or the second position for generating reverse motion of the drive wheel.

The device may include a distributor assembly comprising first and second parts defining the chamber therebetween, wherein the one of the first and second parts are movable with respect to the other between the first and second parts. The first and second parts may be inner and outer parts.

The method may further comprise locking the first and second parts to fix them in relative position with one another in either the first or second position. The method may further comprise unlocking first and second parts to allow them to be moved between the first and second positions. The step of moving the parts may comprise rotating the first part relative to the second part by hand. The first part may be fitted around the second part, and the rotating of the first and second parts may be performed, e.g. slidably, while the first part is fitted around the other part, e.g. by hand twisting the one part with respect to the other.

The method may include setting the supply port of at least one section of the tractor in the first position for forward rotation of the drive wheel, and setting the supply port of in at least one other section of the tractor in the second position for reverse rotation of the drive wheel. The method may then include selectively actuating either the section for forward rotation or the other section for reverse rotation. The forward rotation may provide downhole propulsion and the reverse rotation may provide uphole propulsion of the tractor.

The claims may define one or more further aspects of the invention. Any of the various aspects of the invention may include further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

Various further advantages of the embodiments of the invention and its features are described and will be apparent from the specification throughout.

There will now be described, by way of example only, embodiments of the invention with reference to the accompanying drawings, in which.

Figure 1:
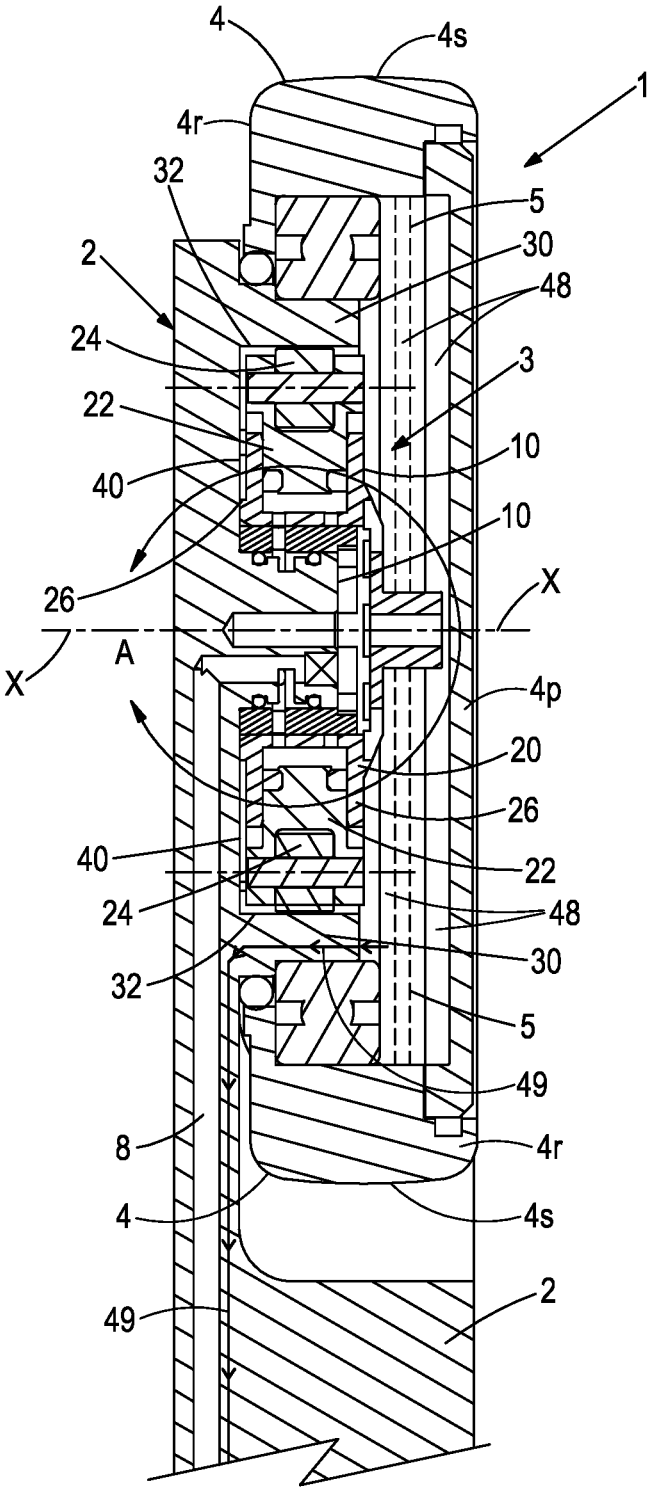
FIG. 1 is a cross-sectional representation of a wheel assembly of a wellbore tractor according to a first embodiment of the invention.

With reference to FIG. 1, a device 1 including a radial piston motor 3 is depicted for hydraulically operating and rotating a drive wheel 4 mounted at an end of a wellbore tractor arm 2.

Near the end of the arm, the arm 2 is configured for supporting working parts of the motor 3, including a rotatable assembly 20. The rotatable assembly 20 is received in an annular cavity 40 in the arm, fitting within the diameter of the wheel 4.

The device 1 includes a cylindrical boss 10 that protrudes from a surface in the arm into an enclosure of the wheel 4. The rotatable assembly 20 has a ring-like configuration and is arranged to fit circumferentially around the boss 10. The assembly 20 is arranged to rotate around the boss 10 about an axis of rotation X that extends through the boss 10. The boss 10 is received in an aperture of the ring-like rotatable assembly 20.

The arm 2 also includes a cam ring 30 extending circumferentially around the rotatable assembly 20. The annular cavity 40 is thus defined in the arm 2 between the cam ring 30 and the boss 10 to accommodate the ring-like rotatable assembly 20.

Furthermore, the device 1 includes a hydraulic oil distributor assembly 12 comprising a distributor sleeve 16 and the boss 10. The hydraulic oil distributor assembly 12 has a distributor sleeve 16 with supply ports 17, as can be seen in more detail with further reference to FIGS. 2 and 3.

The distributor sleeve 16 (an outer part) is fitted around and is rotatable about the boss 10 (an inner part) for allowing the supply ports 17 to be moved and set in a selected first or second position with respect to the cam ring 30. By rotation of the sleeve 16, high pressure hydraulic supply ports 17 in the sleeve 16 are moved from one position to another relative to the cam ring 30. As will be explained in more detail below, this change in position of the supply ports 17 allows the rotation of the rotatable assembly 20 about the axis X to be switched between forward and reverse directions. This can offer a particularly convenient means of changing the direction of operation of drive wheels in wellbore tractors, which can be advantageous in wellbore operations to apply tractive power in downhole or uphole directions in the wellbore.

The rotatable assembly 20 includes radial pistons 22 which operate to produce extension linearly in a direction radially away from the axis X. In so doing, the pistons 22 can impart a force against the cam ring 30 to generate rotation of the rotatable assembly 20.

Figure 4:
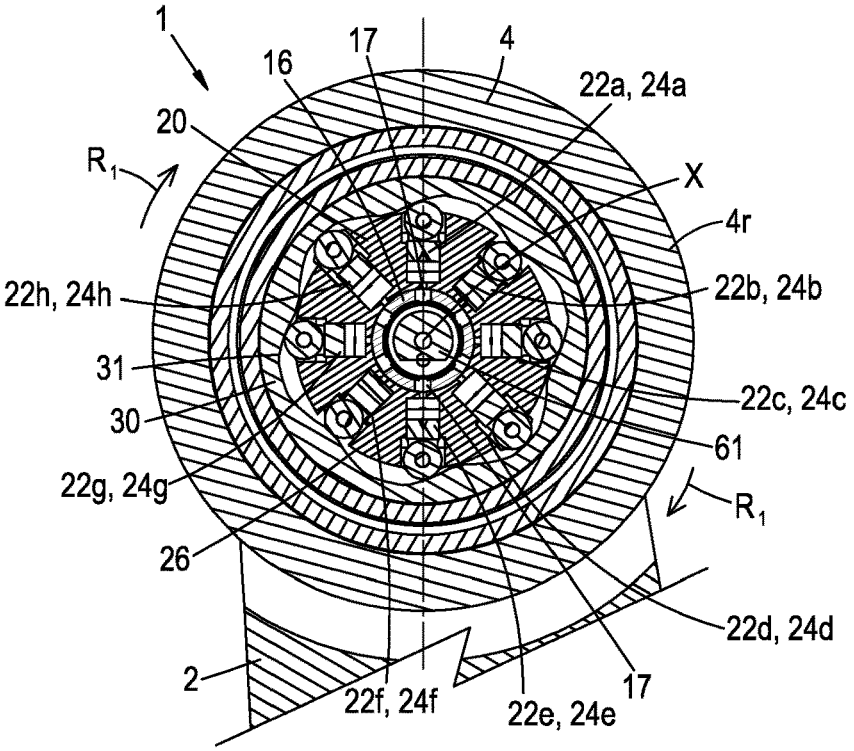
FIG. 4 is a cross-sectional representation of the wheel assembly of FIG. 1 with the oil distributor assembly in a first configuration for forward rotation of a rotor of the radial piston motor.

It can be noted that the pistons 22 are each coupled to a roller 24 at their far ends. As the rotatable assembly rotates, the rollers 24 follow a profile 31 circumferentially around an inside of the cam ring 30. The rollers 24 are arranged to make touching contact with surfaces 32 of the cam profile 31. When a piston 22 is extended radially toward the cam ring 30, the corresponding roller 24 is urged against a surface section 32 of the cam profile 31. The surface section 32 is angled with respect to the direction of extension generated from the piston 22, causing a torque to be imparted to the rotatable assembly 20 to rotate it. The manner in which this rotation is achieved will be described in further detail below. Reference to FIG. 4 may be useful at this point to see more clearly the cam profile 31 and general layout of the device 1.

Figure 2:
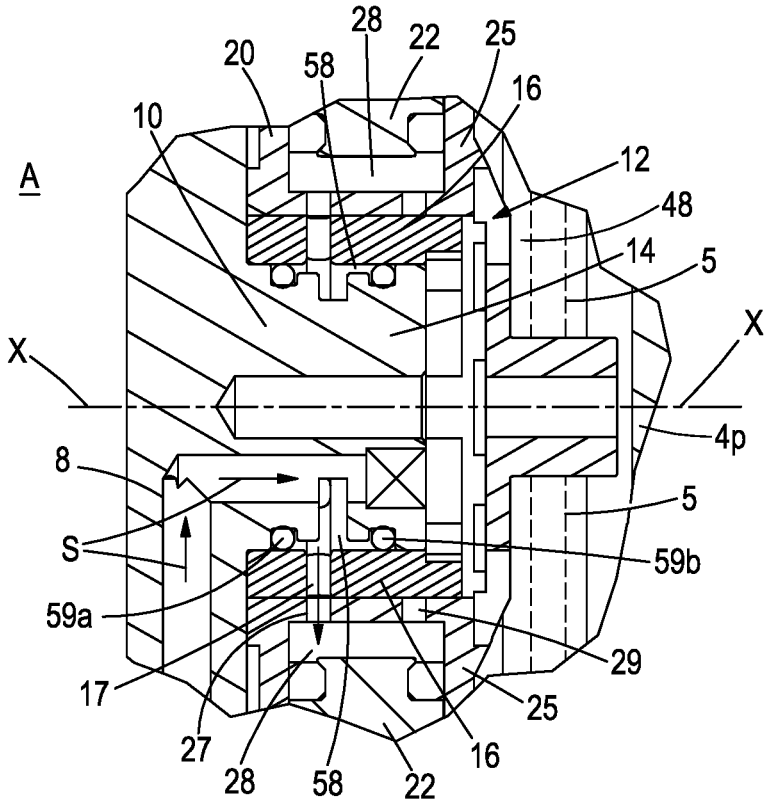
FIG. 2 is a detail representation of the area A of FIG. 1 in close-up.
Figure 3:
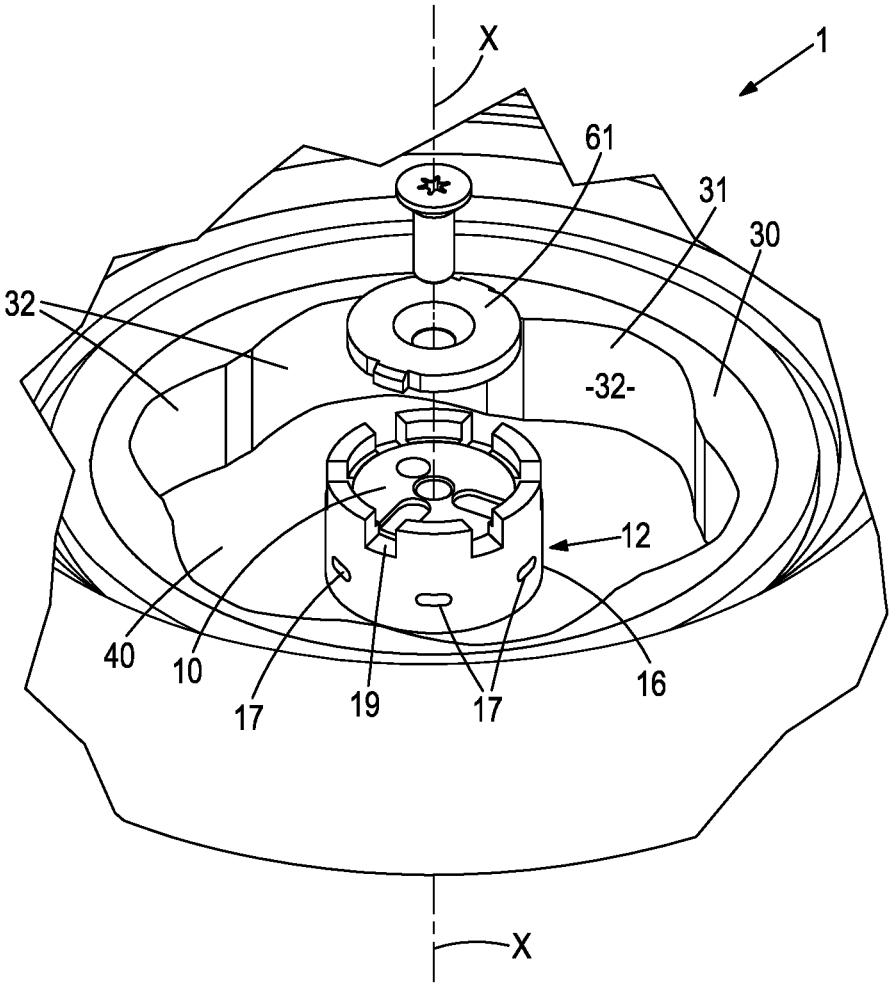
FIG. 3 is a perspective representation highlighting a cam ring and an oil distributor assembly in the wheel assembly of FIG. 1 in larger scale.

With reference again to FIG. 2 and also FIG. 3, detail concerning the boss 10 and the oil distributor assembly 12 can be seen more clearly. The oil distributor assembly 12 functions for distributing hydraulic oil via the supply ports 17 to the pistons 22 for operating the pistons. An annular hydraulic chamber 58 is defined around the boss 10, between the boss 10 and the sleeve 16. Circumferential seals 59*a*, 59*b* (e.g. ring seals) are arranged between the boss 14 and the sleeve 16. The oil is contained in the chamber 58, facilitated by the seals 59*a*, 59*b* to hinder hydraulic oil in the chamber 58 from escaping.

The hydraulic oil is utilized for operating the pistons 22. The oil can be supplied to the pistons 22 as indicated in FIG. 2 by arrows S by pumping the oil through a supply conduit 8 into the annular chamber 58. The oil is supplied to the chamber typically via a single supply conduit, e.g. via hydraulic circuitry from a pump. Oil from the annular chamber 58 can then pass through the ports 17 in the distributer sleeve 16 and into a drive chamber 28 of the piston 22. It will be appreciated that the oil supplied is high pressure oil for driving the piston 22.

The pistons 22 are arranged in piston housings 25 in a body 26 of the rotatable assembly 20. Oil is communicated from the port 17 into the drive chamber 28 of the relevant piston 22 through a supply bore 27 in the piston housing 25. The supply bore 27 communicates oil into the drive chamber which can then exert pressure against a surface of the piston to produce linear extension.

The piston 22 is connected so as to be supplied with oil from the port 17 only when an entrance to the supply bore 27 is aligned with the port 17. In general therefore, the rotation of the rotatable body about the axis X, brings the pistons and the entrances to the supply bores 27 into different positions around the circumference sleeve 16, such that the supply bores 27 are brought into and out of alignment with the ports 17 as rotation advances. Thus, communication via the supply bore 27 for supplying the drive chamber 28 with hydraulic oil at high pressure for acting against the piston and driving the rotation of the assembly 20 is achieved only in particular rotational positions of the assembly 20 when the entrances are aligned with the ports 17.

Several supply ports 17 are disposed in the sleeve 16 around its circumference. As the rotatable body 20 rotates therefore, a given piston 22 may align with one and then another port 17 in different rotational positions where the pistons can be supplied with oil from the annular chamber 58 to drive the piston.

In this example, the piston casing 25 includes a separate extract bore 29. The extract bore 29 communicates hydraulic oil which is being expelled from the drive chamber 28 in a return cycle of the piston from the drive chamber 28 out of the assembly and into a flow space defined by a notch 19 in the distributor sleeve 16. The notches 19 for extracting the oil are interspersed between the supply ports 17 circumferentially around the sleeve 16. The extract bore 29 connects to the notch 19 to allow the extraction of the oil from a given piston 22 in particular rotational positions of the assembly 20 where that piston 22 is not connected to a supply port 17 via the supply bore 27.

The extract bore 29 aligns with designated notches 19, see FIG. 3, in rotational positions of the assembly where the piston retracts and undergoes the return cycle. The expelled fluid from the drive chamber 28, then passes out of the drive chamber 28, through the extract bore 29 and the opening of the notch 19. The oil then travels through the notch 19 and onward on a drain path through the space 48 in the enclosure to low pressure hydraulic tank.

An advantage of the second, extract bore 29 communicating with the drive chamber 28 can be that the extract bore 29 can be configured somewhat differently from the supply bore 27, e.g. the supply path may be independent of the drain path. It may also allow the notches 19 to be positioned on the sleeve 16 of the distributor assembly in a favourable location and in specific position for communicating low pressure return oil to the drain path. In this example, the notches 19 for extracting return oil are axially (and of course circumferentially) offset with respect to the supply ports 17. Thus, extracted low-pressure hydraulic fluid is not returned through the same conduits as the high-pressure fluid supplied to the pistons, which can improve design and operability of the motor.

Importantly, the oil distributor assembly 12 is configurable such that the distributor sleeve 16 can be positioned in different rotational positions with respect to the cam profile 31.

This means that the ports 17 in the sleeve 16 obtain a corresponding different angular position. Therefore, upon rotation of the rotatable assembly 20 about the boss 10, a given piston 22 will be activated at a different point along the cam profile 31 of the cam 30 (when connected to a supply port 17). In particular, as will be seen below, the sleeve 16 can be positioned in one rotational position so that the pistons 22 operate to generate rotation of the rotatable assembly 20 in a first, forward direction around the boss 10, or in another rotational position so that the pistons 22 operate to generate rotation of the rotatable assembly 20 in second opposite or reverse direction around the boss 10. A locking ring 61 is provided for locking the distributor sleeve 16 with respect to the boss 10 in the selected or desired position.

In further detail, the wheel 4 is arranged to cover and enclose the hydraulic motor 3 and other working parts, e.g. the rotatable assembly, cavity, the boss, the distributor, the cam, and/or the geared coupling. This can prevent unwanted debris and dirt from entering the interior of the device and interfering with the workings of the motor and transmission to the wheel 4. To this end, the wheel 4 comprises an external wheel ring **4*r* comprising a wheel surface 4*s*, e.g. with tread or grooves or the like, for contacting the wellbore wall, and a side cap 4*p*, in this example in the form of a disc or plate, covering the area inside the ring 4*r* around which the external wheel ring 4*r* extends. In this way, the motor and other working parts of the device are enclosed by the wheel 4**.

Return oil which is expelled from the pistons 22 passes from the notches 19 into the relatively open region of space 48 within the enclosure of the wheel 4, i.e. internally to the wheel ring **4*r* and between the side cap 4*p* and the arm 2. The wheel ring 4*r* and side cap 4*p* are arranged to seal off the space 48 such that the return oil on the drain path can be contained within it (at low pressure). The return oil exits the space 48 of the enclosure of the wheel 4 into a separate hydraulic drain conduit or drain line 49 (depicted schematically) in the arm 2, and through the drain conduit or drain line 49** to low pressure tank.

Figure 22:
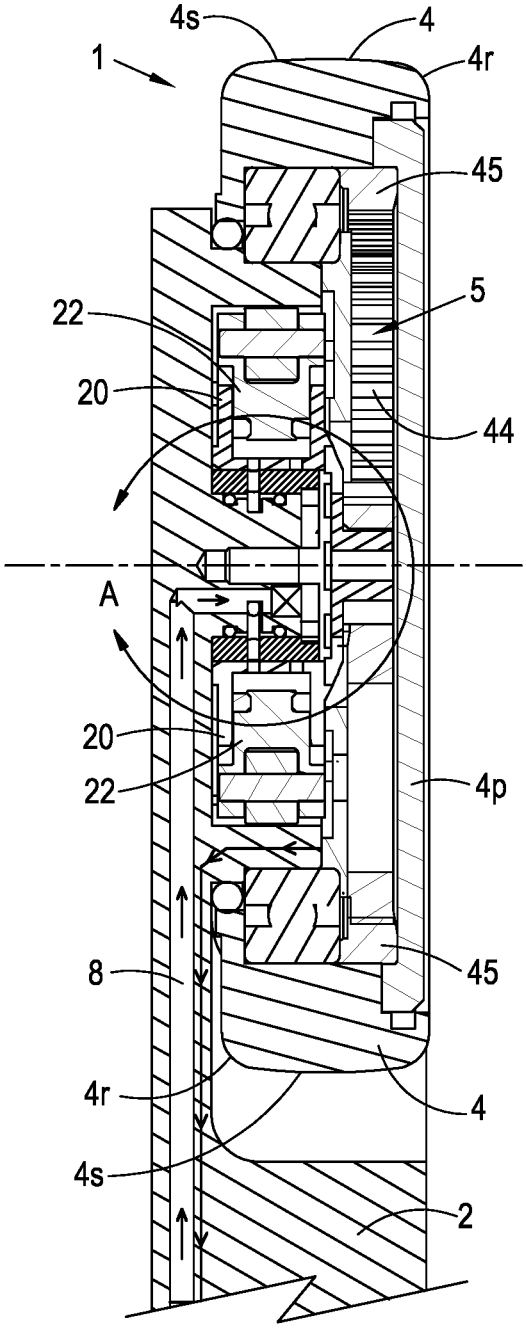
FIG. 22 is a cross-sectional representation of the wheel assembly of FIG. 1, showing detail of the coupling between the wheel and rotatable assembly.
Figure 23:
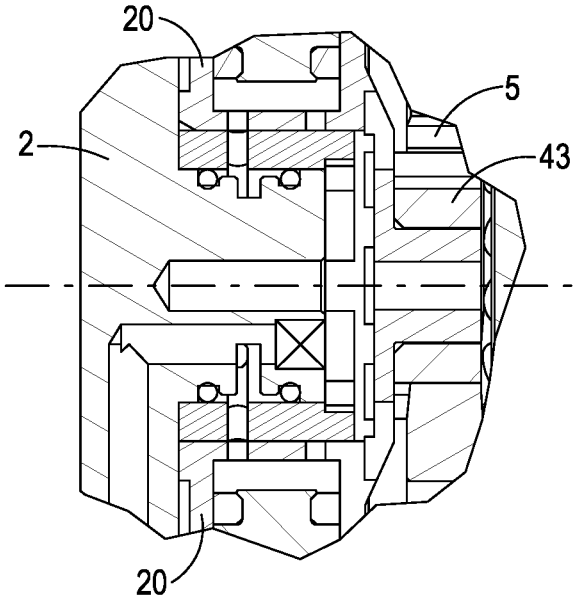
FIG. 23 is a detail representation of the area A of FIG. 22 in close-up.
Figure 24:
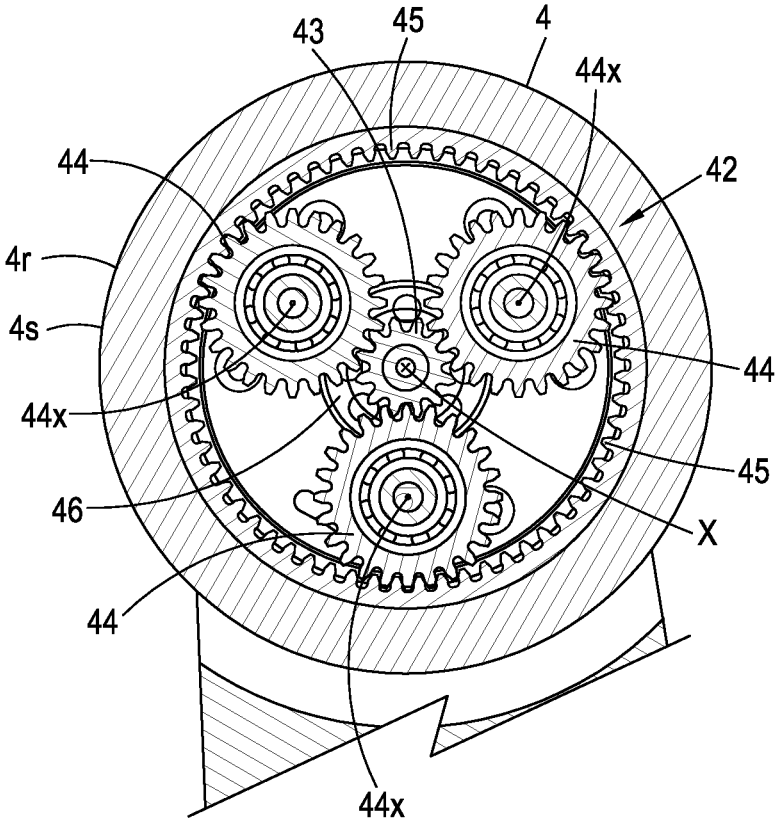
FIG. 24 is a cross-sectional representation of the wheel assembly of FIG. 22 perpendicular and in smaller scale relative to the section of FIG. 22, showing detail of the gear arrangement of the coupling between the wheel and the rotatable assembly.

The wheel 4 is coaxially arranged and rotatable about the same axis X as the rotatable assembly. The wheel 4 is coupled to the rotatable assembly 20 through a coupling 5, indicated schematically in dashed outline in FIG. 1. The coupling 5 may for instance be a direct coupling or a geared coupling, e.g. provided via planetary gears. Referring to FIGS. 22 to 24, the coupling 5 is provided by gear arrangement 42 in this case of planetary type including planet gears 44. The rotation of the rotatable assembly 20 can thus be transmitted to the wheel 4 by way of the coupling 5.

More specifically, the gear arrangement 42 has an inner sun gear 43, an outer ring gear 45, and intermediate planet gears 44. The sun gear 43 is attached to the motor, i.e. to the rotatable assembly 20. The rotatable assembly 20 and sun gear 43 thus rotate coaxially together (in the same sense) relative to the arm 2, about the axis X. Arranged around the sun gear 43 are three planet gears 44. These are arranged between the sun gear 43 and the ring gear 45. The planet gears 44 have axes of rotation **44*x* which are fixed with respect to the arm 2, since they are attached to a carrier plate 46 which in turn is fixed to the arm 2. The planet gears 44 are therefore rotatable about their respective axes 44*x*. The outer ring gear 45 is attached to the external wheel 4. The sun gear 43 engages each of the planet gears 44, and each of the planet gears 44 in turn engages the ring gear 45. Rotation of the motor (i.e. the rotatable assembly 22) is thus transmitted through the planet gears to the external wheel ring 4*r***.

Such coupling 5 can be advantageous to produce power transmission from the rotational assembly to the drive wheel 4 for obtaining desired torque and facilitating traction of the wheel 4 against a wall of the wellbore. Furthermore, an effective transmission to the wheel 4 can be advantageously achieved by the radial piston motor 3 within the enclosure of the wheel 4 using a stationary cam 30 that is built into the arm 2. This can be facilitated by the configuration of the drain path for return oil through the open space 48 of the enclosure of the wheel 4. This configuration can allow wireline tractors to be offered for operation or more effective operation in far reach small diameter wellbore sections.

Turning then to refer additionally to FIGS. 4 to 7, it can be seen how the rotation of the rotatable assembly 20, and in turn therefore the rotation of the wheel 4, can be reversed by rotationally repositioning the distributor sleeve 16 with respect to the cam profile 31 and along the rotation path of the assembly 20.

Figure 5:
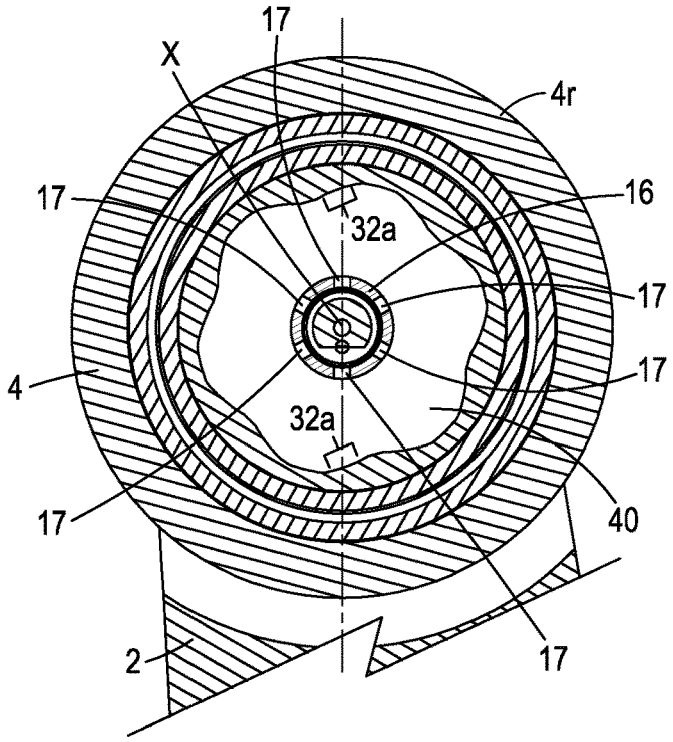
FIG. 5 is a cross-sectional representation of part of the wheel assembly in the configuration of FIG. 4 but with the rotor omitted.

In FIGS. 4 and 5, a first configuration is shown. The pistons 22 are for the purposes of these figures referenced individually as pistons **22*a* to 22*h*. The piston 22*a* (and corresponding roller 24*a*) is aligned to engage with a sloping surface section 32*a* which slopes away clockwise from a crest in the cam profile 31 toward a trough. The piston 22*a* operates in a pair together with piston 22*e* which is disposed on the body 20 in 180 degrees opposite orientation to the piston 22*a*. The pistons 22*a*, 22*e* are aligned with the corresponding ports 17 in the distributor sleeve 16 such that both are connected to the annular chamber 58 and receive hydraulic oil at high pressure from the chamber 58 in the drive chambers 28 of the respective pistons 22*a*, 22*e*. The pistons 22*a*, 22*e* are driven by the fluid in the drive chambers 28 and push against the surface sections 32*a*, while linearly extending radially away from the sleeve 16. The surface sections 32*a* that the pistons 22*a*, 22*e* engage on the cam profile 31 are arranged at an inclined angle with respect to the direction of linear motion of the pistons 22***a*, 22*e*, resulting in an angular force being imparted to the rollers 24 from the surface sections 32*a*, so that the body 20 is turned clockwise as indicated by arrows $R_1$.

Note that it is only the pistons 22*a*, 22*e* that are aligned with respective ports 17 and being driven by the hydraulic fluid from the distributor sleeve 16. In the indicated position of the assembly 20 in its rotational cycle, the other ports 17 of the distributor sleeve 16 are not actively in use in transmitting hydraulic fluid to power the pistons.

Three other sets of 180 degree cooperating pairs of pistons 22 are present on the body 20. The pair of pistons 22*c*, 22*g* in FIGS. 4 and 5 are in the process of retracting as the rotational assembly 20 rotates clockwise. The drive chambers 28 of those pistons 22*c*, 22*g* are discharging low pressure fluid through the second, extract bore 29 which is aligned and in communication with the notches 19 in the sleeve 16 to a drain path.

The other two pairs of pistons, namely the pair of pistons 22*b*, 22*f* and pair of pistons 22*d*, 22*h* are neither connected to the drain path nor the supply path from the hydraulic chamber 58. The pistons 22*b*, 22*f* are positioned so that respective rollers 24 are fully extended and located in a trough of the cam profile 31 having undergone an earlier drive cycle. Upon further rotation of the rotational assembly 20 about the boss 10 and distributor sleeve 16) the rollers 24 will travel on the slope from the trough to the next crest in the cam profile 31, causing discharge of low-pressure oil from the drive chambers 28 to the drain path.

Conversely, the pistons 22*d*, 22*h* are positioned so that respective rollers 24 are fully retracted and located on a crest of the cam profile 31 having completed an earlier discharge cycle. Upon further rotation of the rotational assembly 20 about the boss 10 (and sleeve 16) the rollers 24 will travel on the slope from the crest to the next trough in the cam profile 31, with high pressure fluid being supplied on a supply path from the port 17 in the sleeve 16 to the drive chambers 28 for driving the extension of the pistons 22*d*, 22*h* and rotation of the rotatable assembly 20.

In this manner, the various piston pairs operate in sequence to extend and retract in an alternating pattern as the rotatable assembly 20 rotates, as and when through rotation the necessary alignment with ports/notches in distributor sleeve 16 is obtained. The extraction phase of the pistons drives rotation against the cam under high pressure, while due to the mechanical interaction with the profile of the cam as the rotatable assembly 20 rotates, the surface sections of the cam profile 31 force the pistons subsequently to retract against low pressure. The operation in pairs can double the power available as opposed to other variants for instance using just one piston actively to drive rotation at any one time.

Figure 6:
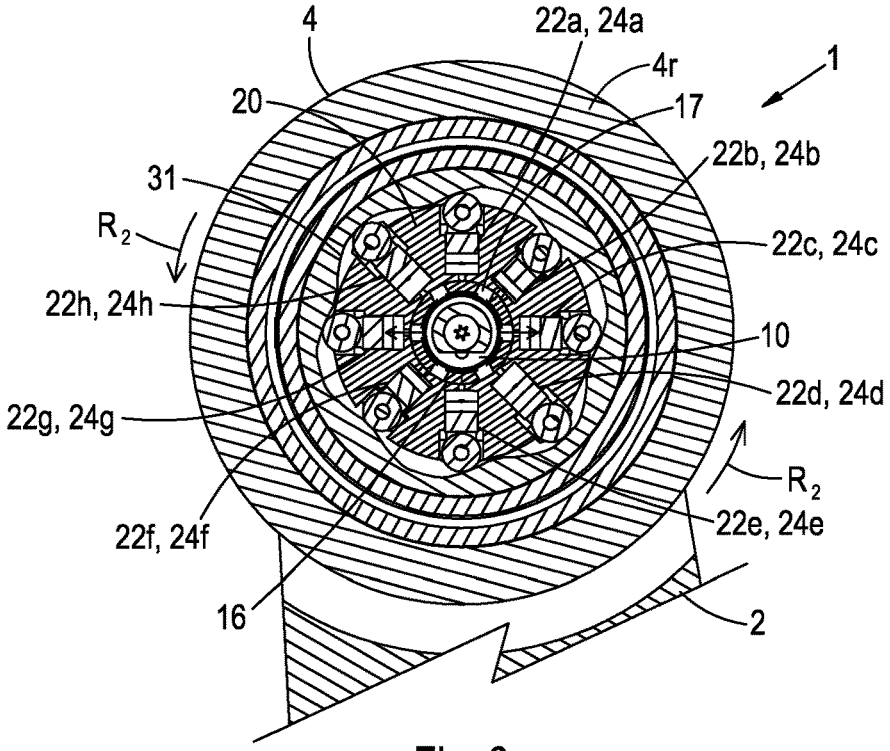
FIG. 6 is a cross-sectional representation of the wheel assembly of FIG. 1 with the oil distributor assembly in a second configuration for reverse rotation of the rotor of a radial piston motor.
Figure 7:
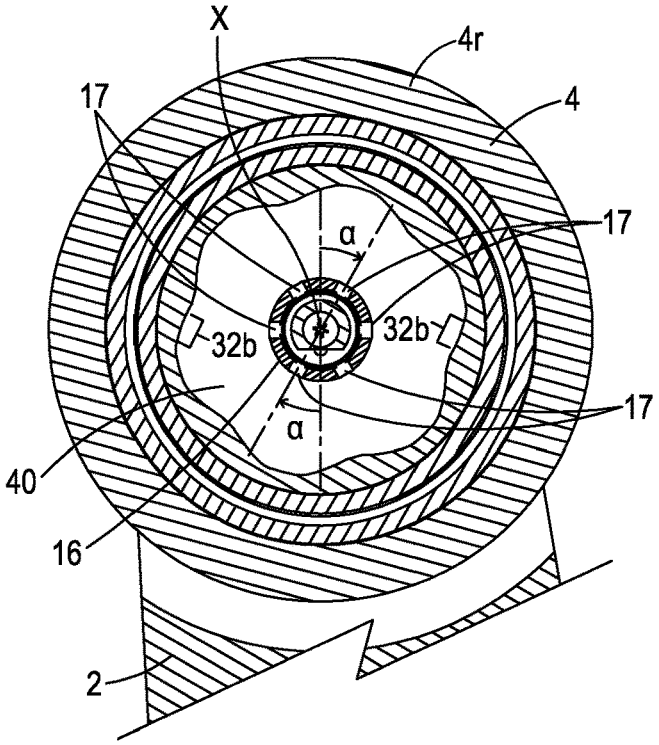
FIG. 7 is a cross-sectional representation of the wheel assembly of FIG. 6 with the rotor removed.
Figure 8:
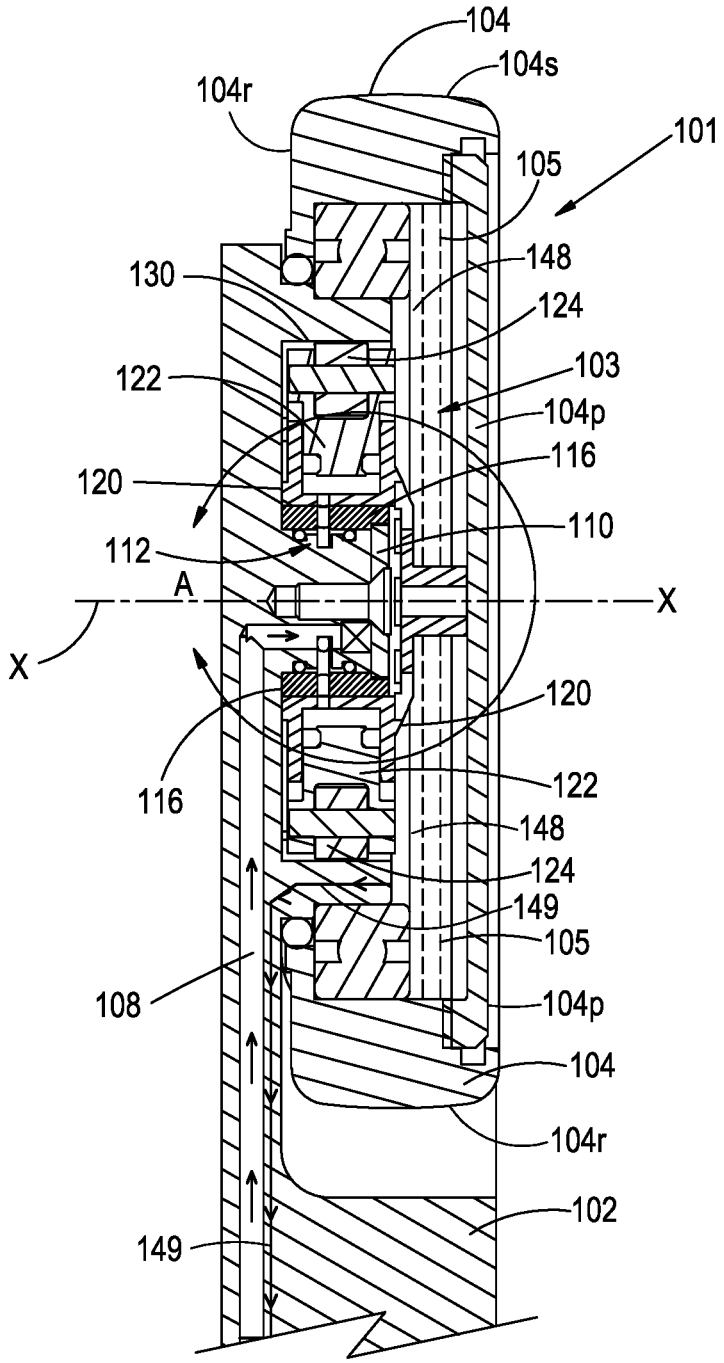
FIG. 8 is a cross-sectional representation of a wheel assembly of a wellbore tractor including a radial piston motor, according to a second embodiment of the invention.
Figure 9:
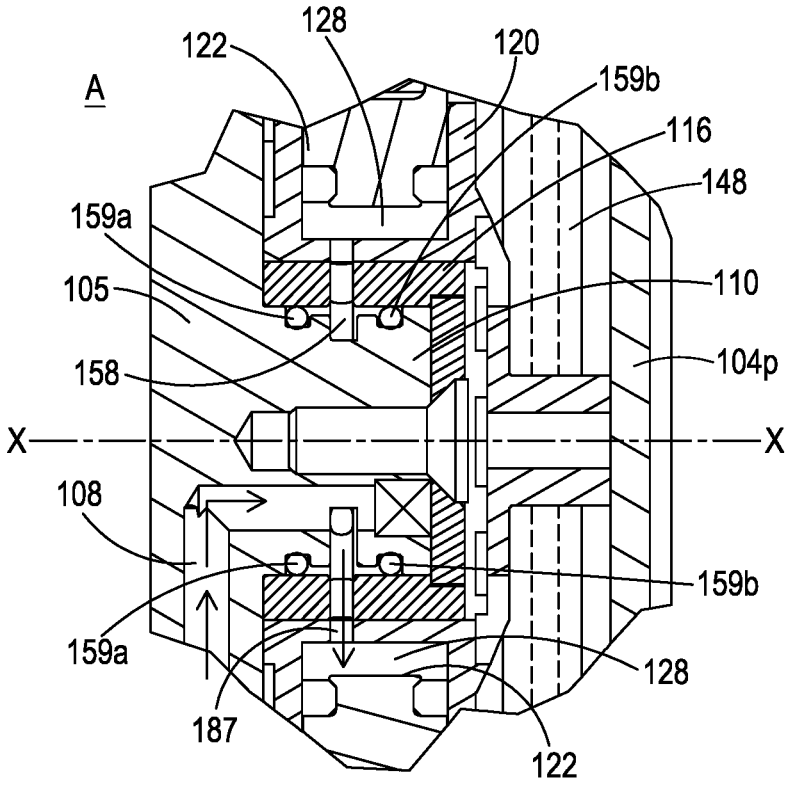
FIG. 9 is a detail representation of the area A of FIG. 8 in close-up.
Figure 10:
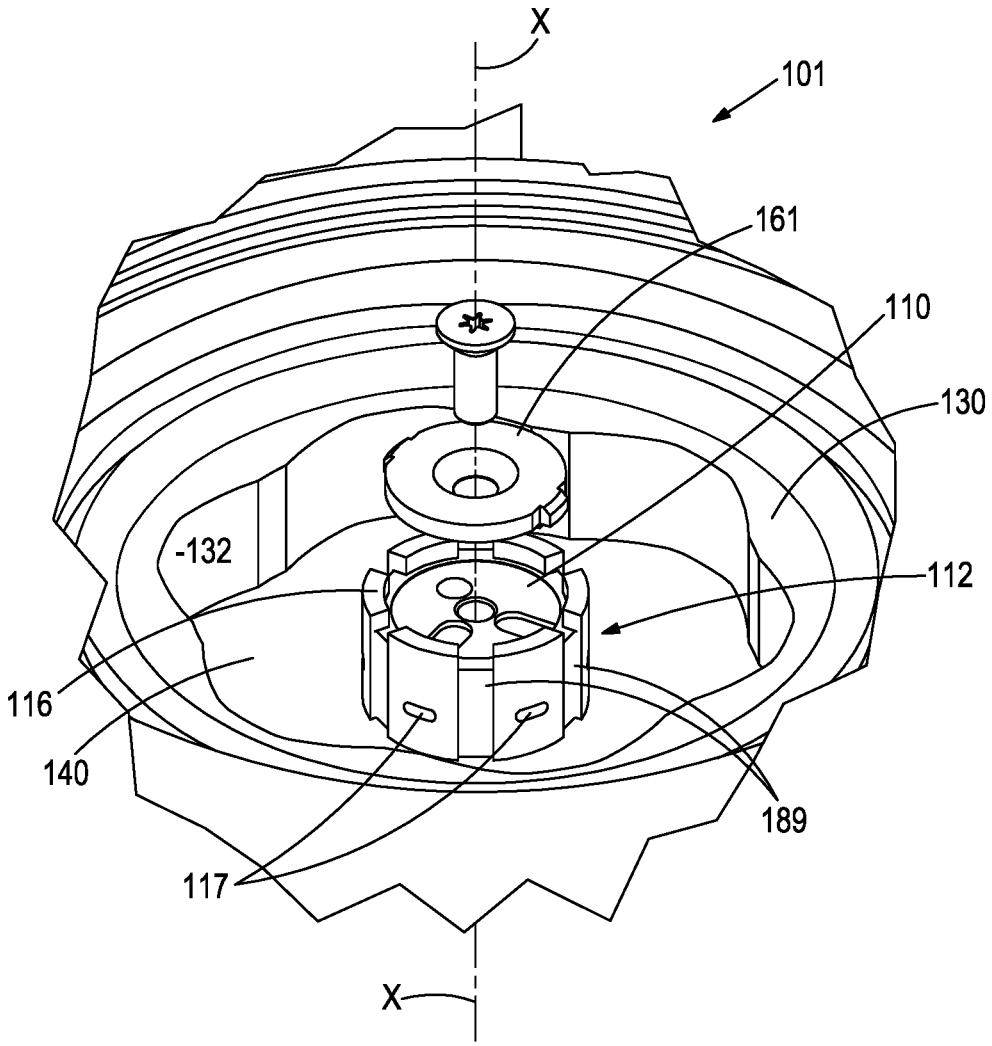
FIG. 10 is a perspective representation highlighting a cam ring and an oil distributor assembly in the wheel assembly of FIG. 1 in larger scale.
Figure 11:
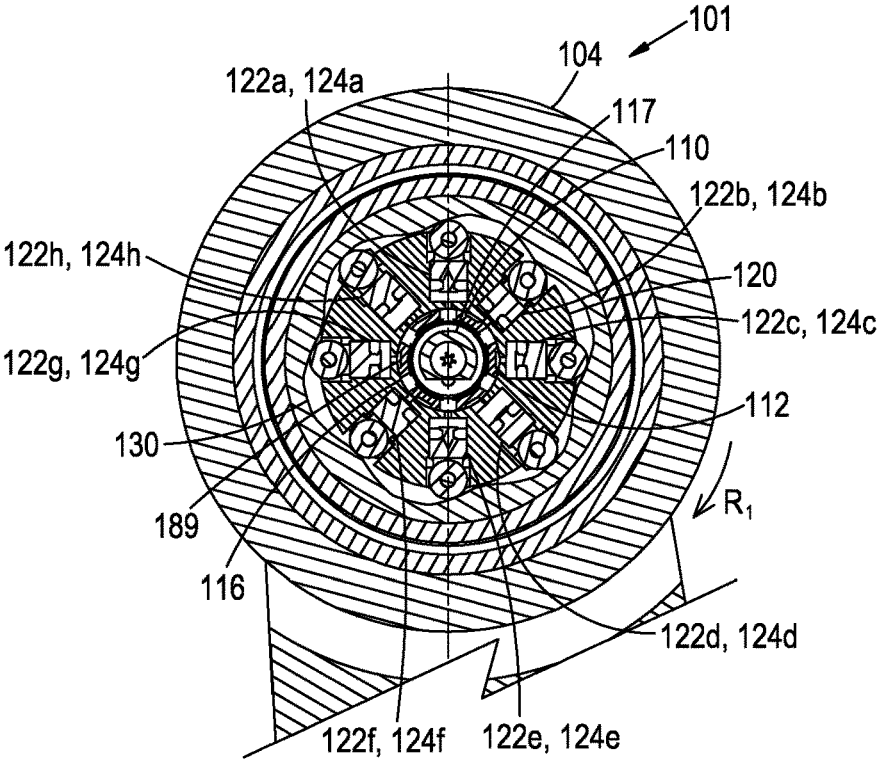
FIG. 11 is a cross-sectional representation of the wheel assembly of FIG. 8 with the oil distributor assembly in a first configuration for forward rotation of a rotor of the radial piston motor.
Figure 12:
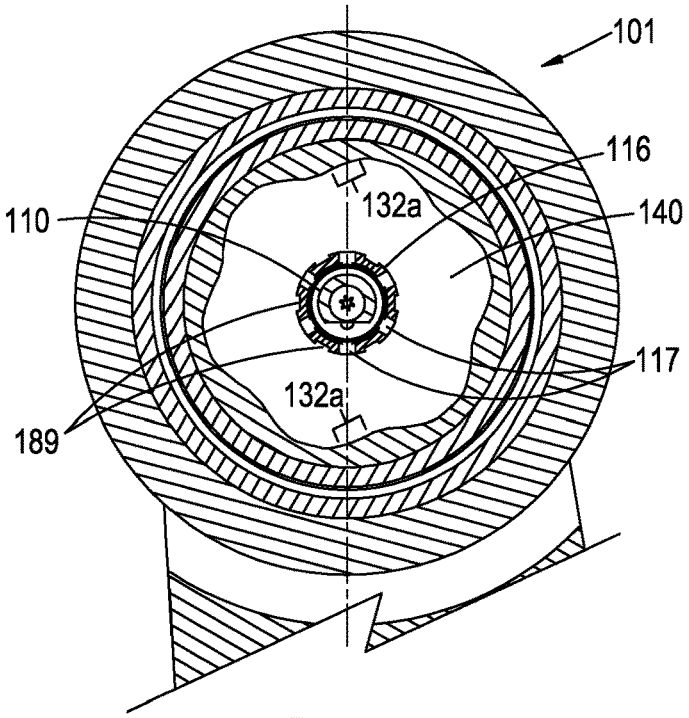
FIG. 12 is a cross-sectional representation of part of the wheel assembly in the "forward" configuration of FIG. 11 but with the rotor omitted.
Figure 13:
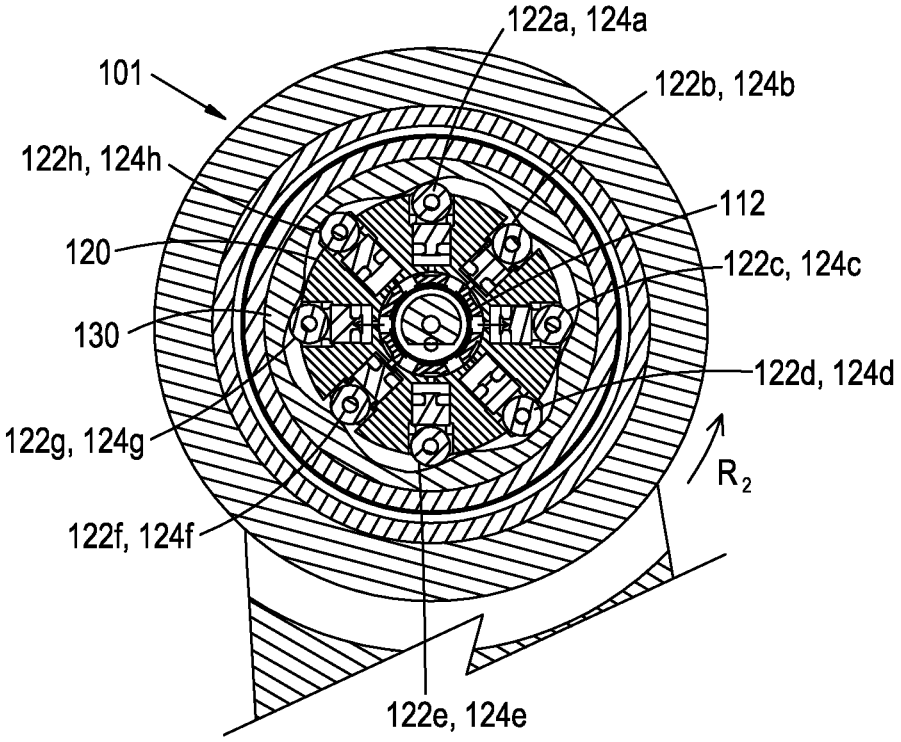
FIG. 13 is a cross-sectional representation of the wheel assembly of FIG. 8 with the oil distributor assembly in a second configuration for reverse rotation of the rotor of the radial piston motor.
Figure 14:
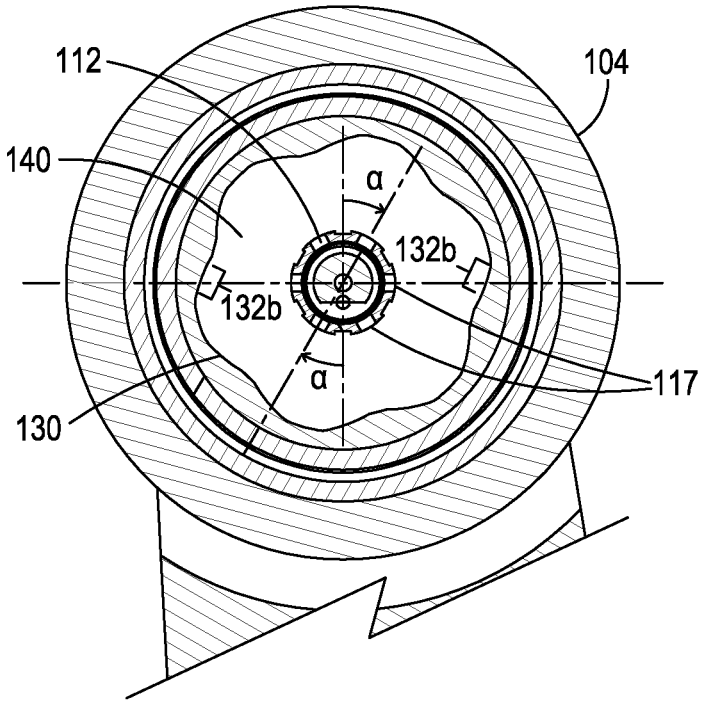
FIG. 14 is a cross-sectional representation of the wheel assembly in the "reverse" configuration of FIG. 13 but with the rotor removed.
Figure 15:
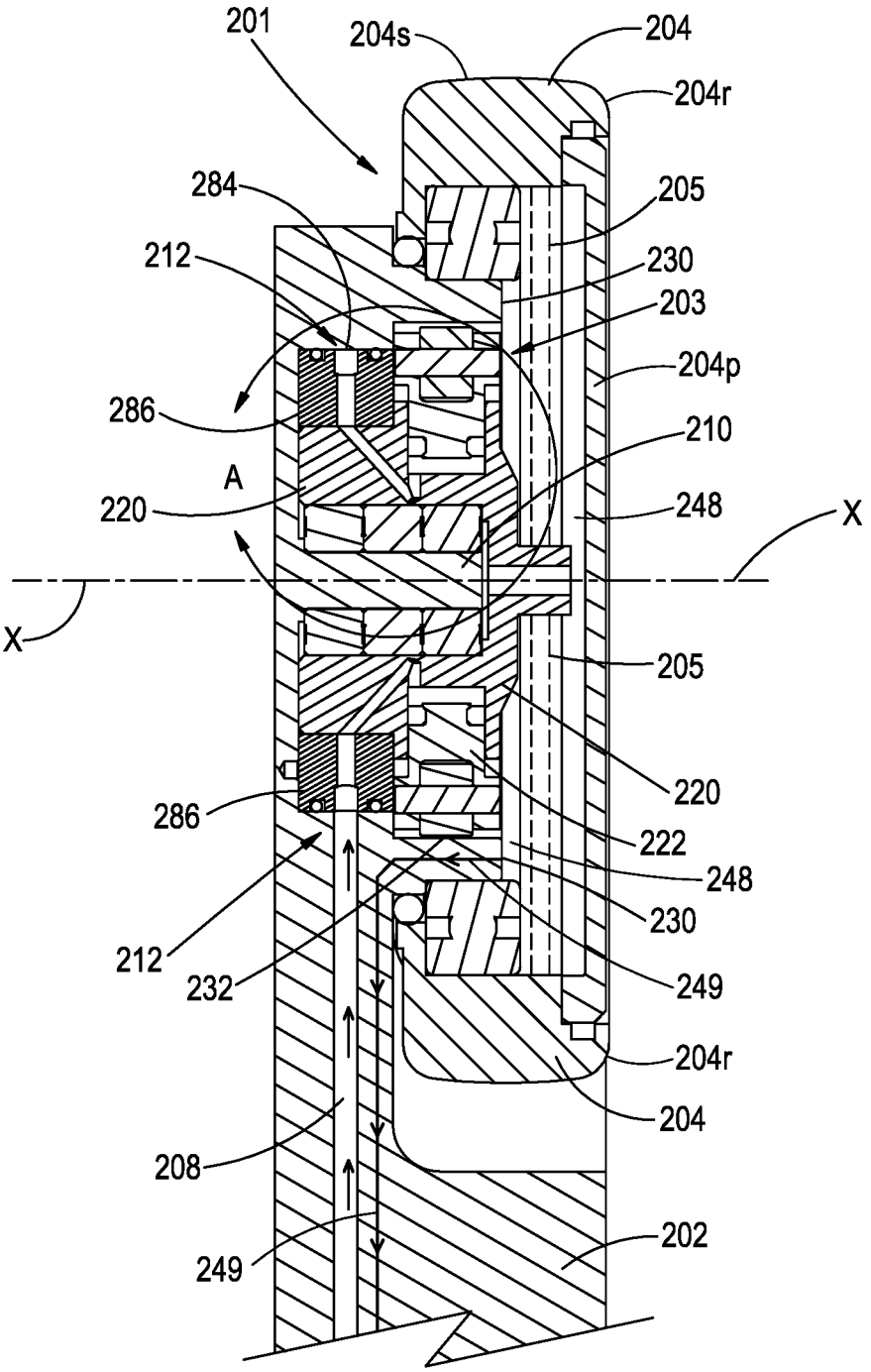
FIG. 15 is a cross-sectional representation of a wheel assembly of a wellbore tractor including a radial piston motor, according to a third embodiment of the invention.
Figure 16:
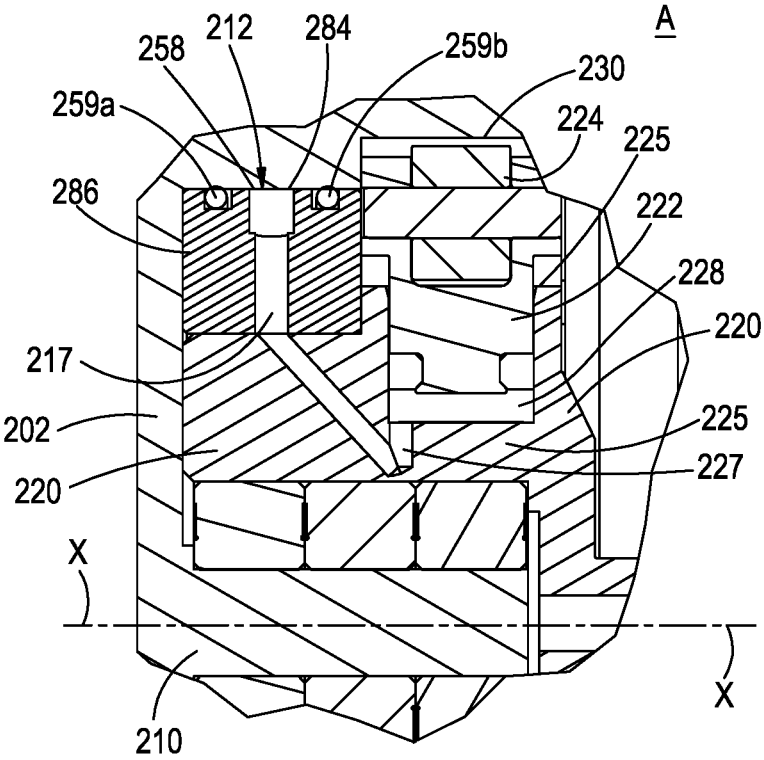
FIG. 16 is a detail representation of the area A of FIG. 15 in close-up.
Figure 17:
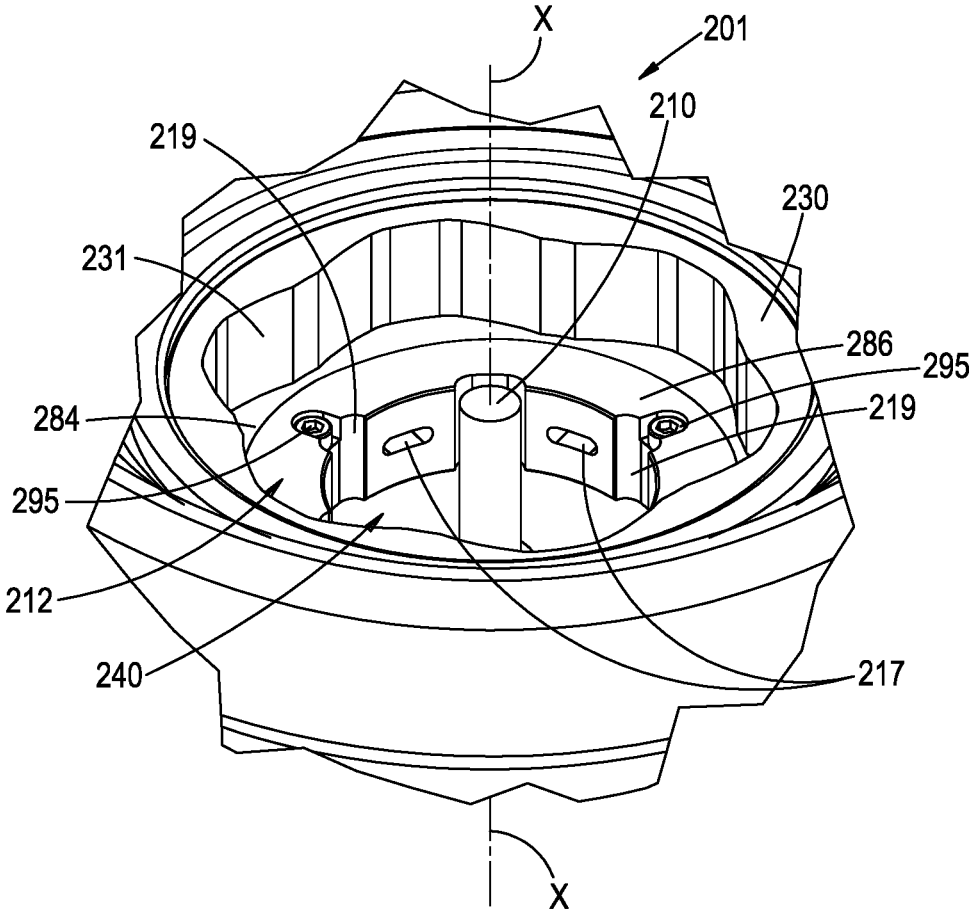
FIG. 17 is a perspective representation highlighting a cam ring and an oil distributor assembly in the wheel assembly of FIG. 15 in larger scale.
Figure 18:
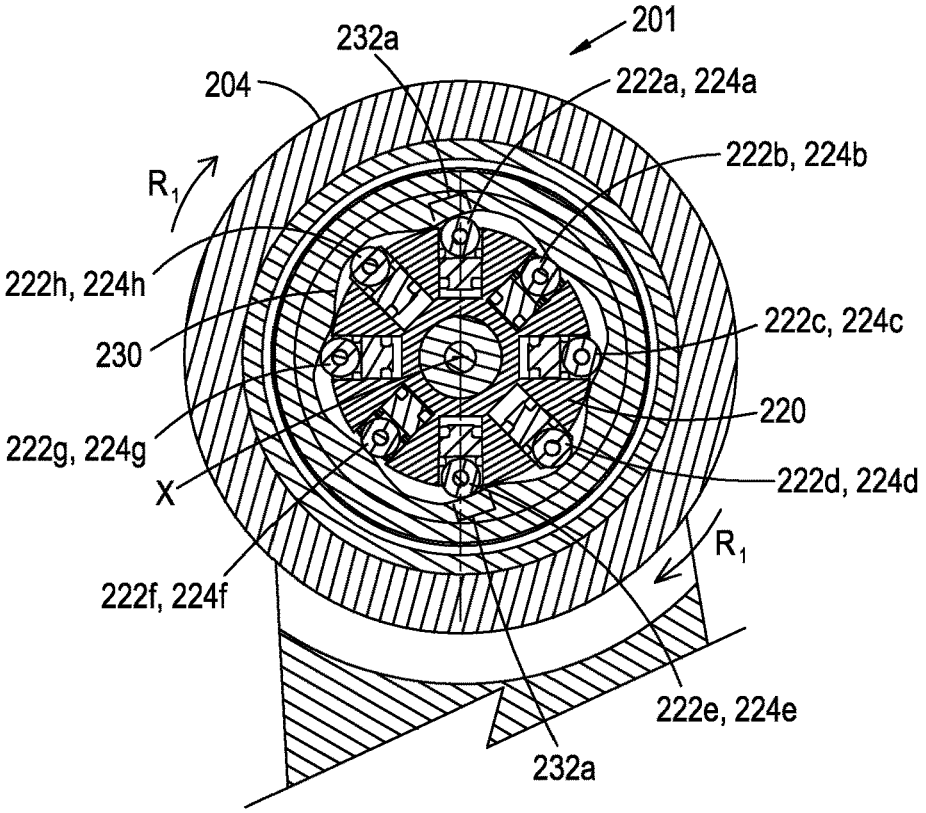
FIG. 18 is a cross-sectional representation of the wheel assembly of FIG. 15 with the oil distributor assembly in a first configuration for forward rotation of a rotor of the radial piston motor.
Figure 19:
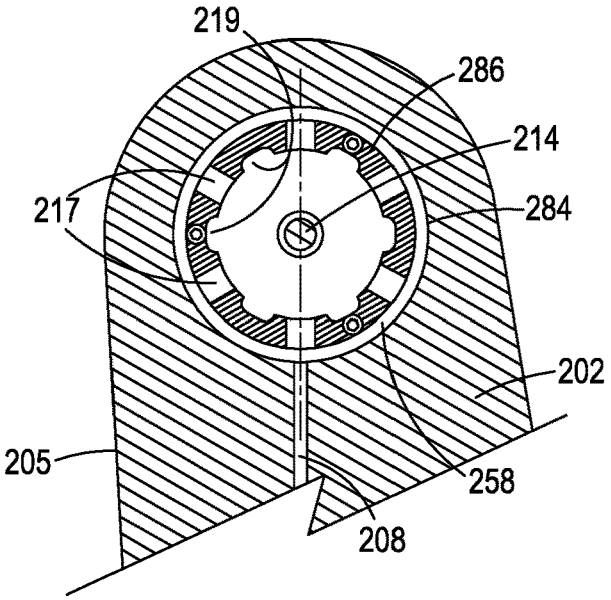
FIG. 19 is a cross-sectional representation of part of the wheel assembly in the "forward" configuration of FIG. 18 but with the rotor omitted.
Figure 20:
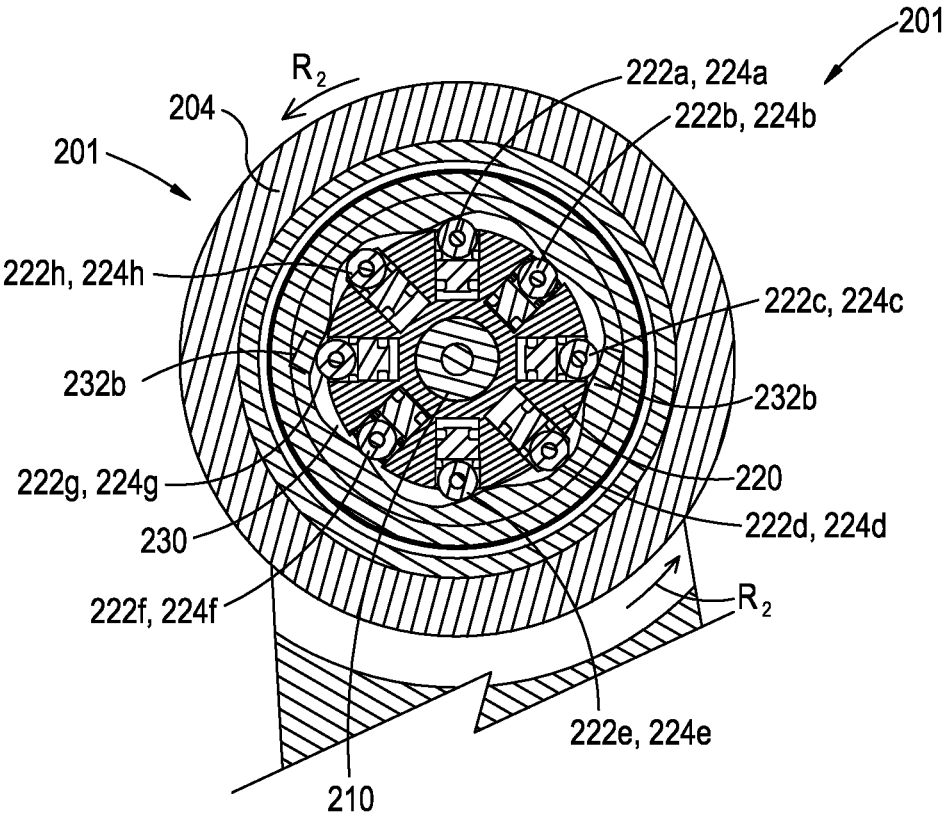
FIG. 20 is a cross-sectional representation of the wheel assembly of FIG. 15 with the oil distributor assembly in a second configuration for reverse rotation of the rotor of the radial piston motor.
Figure 21:
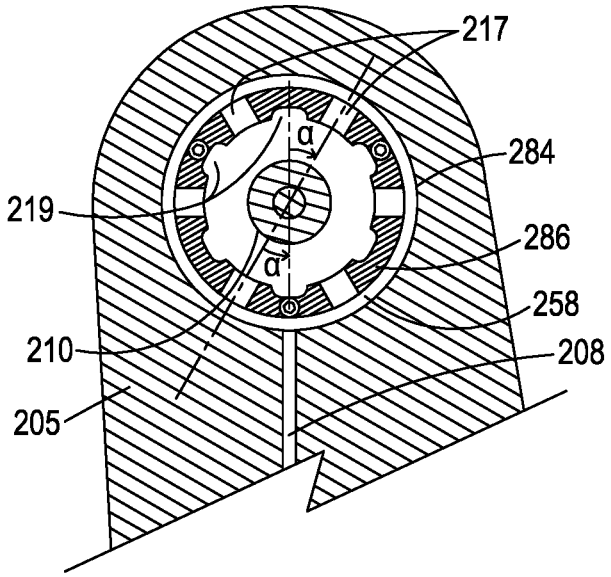
FIG. 21 is a cross-sectional representation of the wheel assembly in the "reverse" configuration of FIG. 20 but with the rotor removed.

In FIGS. 6 and 7, the general operation of the rotatable assembly 20 is the same as above, except the direction of its rotation is reversed. The rotatable assembly 20 is rotatable in the direction indicated by arrows $R_2$. Sequential extension and retraction of pistons takes place in the same way as the assembly 20 rotates, with the rollers 24 following the cam profile 31 circumferentially around the inside of the cam ring 30. The important and only difference in configuration to note here, however, is that the distributor sleeve 16 is positioned in a different orientation with respect to the cam profile 31. As can be seen in FIG. 7, the cam ring 31 and distributor sleeve 16 are arranged concentrically, and the sleeve 16 has been rotated with respect to the cam profile 31, and the boss 10, by an angle $\alpha$ of 30 degrees.

Thus, the ports 17 for supplying high pressure hydraulic oil from the annular chamber 58 connect with pistons 22 when the pistons are positioned to engage surfaces 32*b* of the cam profile 31 that slope away from a crest toward a trough anti-clockwise from the crest, producing torque and movement of the rotatable assembly 20 in a direction indicated with arrows $R_2$ which is opposite to the direction $R_1$ of FIGS. 4 and 5.

More specifically, in the rotational position of the assembly 20 in FIG. 6, the piston 22*c* (and corresponding roller 24*c*) is aligned to engage with a sloping surface section 32*b* which slopes away from a crest in the cam profile 31 toward a trough in an anti-clockwise direction. The piston 22*c* operates in a pair together with piston 22*g* which is disposed in the assembly 20 in 180 degrees opposite orientation to the piston 22*c*. In this case, the pistons 22*c*, 22*g* are aligned with ports 17 in the distributor sleeve 16 such that they are both connected to the annular chamber 58 and receive hydraulic oil at high pressure from the chamber 58 in the drive chambers 28 of the respective pistons 22*c*, 22*g*. The pistons 22*c*, 22*g* are driven by the oil in the drive chambers 28 and push against the surface sections 32*b*, while linearly extending radially away from the sleeve 16. The surface sections 32*b* that the pistons 22*c*, 22*g* engage with on the cam profile 31 are arranged at an inclined angle with respect to the direction of linear motion of the pistons 22*c*, 22*g* resulting in an angular force being imparted to their respective rollers 24 from the surface sections 32*b*, so that the body 20 is turned anti-clockwise as indicated by arrows $R_2$.

With regard to the other pairs of pistons, it can be seen that pistons 22*a*, 22*e* are discharging while connected to the drain path via bore 29 and notch openings 19. The others are neither discharging nor being driven, and are not aligned with either the notch openings 19 or the ports 17. More specifically, the pair of pistons 22*b*, 22*f* are fully retracted awaiting next a drive phase which will commence when the supply bore 27 aligns with the next supply port 17 upon further rotation of the assembly 20. The pair of pistons 22*d*, 22*h* are fully extended awaiting next a discharge phase which will commence when the supply bores 27 of the pistons 22*d*, 22*h* align with the next supply port 17 in the distributor sleeve 16 along its circumference.

Providing the distributor assembly 12 where the distribution sleeve 16, and its associated ports 17, is readily positioned in different rotational orientations and rotated relative to the cam profile 31 for obtaining the reverse direction can be advantageous. In particular, the direction of rotation of a tractor drive wheel 4 coupled to the assembly, can be switched without requiring more extensive reconfiguration, and the supporting hydraulic circuitry for supplying hydraulic oil to the distributor assembly can effectively be the same for both directions of rotation while minimizing need for bi-directional hydraulic circuitry. Open space within the enclosure of the wheel 4 can be used for containing low pressure hydraulic fluid being returned from the pistons on the drain path during their discharge in both directions of rotation.

Practically, in order to position and set the distributor sleeve 16 in different orientations, the sleeve 16 can be released from the boss 10 and rotated relative to the boss 10 to place the ports 17 in the necessary rotated position, in this case 30 degrees circumferentially about the boss 10 from the earlier position. When in the desired position, the sleeve 16 is locked relative to the boss 10 by a locking plate which is fastened in place by a releasable fastener, in this case a tightening screw, to the boss 10. The motor can then be operated as described above, obtaining rotation of the assembly 20 in the forward direction. In order to move the ports 17 to the other position, the tightening screw is undone and the locking plate 61 for locking the sleeve 16 with respect to the boss 10 is released to allow the sleeve 16 to be rotated to the new position. The sleeve 16 can be rotated to the new position by hand, for example by sliding and turning it by hand about the boss 10 while the circumferential seals in the distributor assembly 12 remain in place. Before rotating the sleeve 16, the rotatable assembly 20 is typically removed from the motor cavity 40. The seals may be elastomer ring seals or similar. The sleeve 16 could also be lifted off the boss 10 and then replaced back on the boss 10 in the rotated position. No adhesive or the like is used or required between the distributor sleeve 16 and the boss 10.

The process of positioning the sleeve 16 above exemplifies a manual "pre-set" process which may be employed in the course of assembly or pre-configuration of a tractor section before deployment in a wellbore. Thus, wellbore tractor sections, e.g. drive sections, can be configured before deployment in a wellbore by setting the ports 17 in either the first position or second position for forward or reverse rotation of the rotatable assembly 20. By the manual pre-setting of the sleeve prior to deployment, the tractor can incorporate drive sections that are dedicated to uphole or downhole propulsion during the subsequent deployment and operation in the well.

In some operations, one or more tractor sections may have the sleeve 16 set in the position for forward rotation to facilitate movement of the tractor downhole and one or more tractor sections may have the sleeve 16 set in the other position for reverse rotation to facilitate movement of the tractor uphole, as may be useful e.g. to help to dislodge equipment or pull equipment out of the wellbore, e.g. in well intervention. As such, forward and reverse tractor sections can easily be configured and can be deployed in the same run in a wellbore. In such embodiments however, the sections for movement downhole and the sections for movement uphole would not both be operational at the same time. The tractor is therefore arranged to be able to select and operate separately either the "uphole" or the "downhole" sections. Different drive sections of a tractor can be selectively activated and deactivated through the hydraulic system in the tractor. In the present example, such a hydraulic system can be employed to operate the motor 3 of a first drive section with ports 17 in the distributor assembly 12 positioned for downhole movement and operate another motor 3 of a second drive section with ports 17 in the distributor assembly 12 set for uphole movement. By using a bypass line and arranging a valve module between the first and second drive sections, a supply of hydraulic fluid from a distribution point in the valve module to the hydraulic motor of either the first or the second drive sections can be switched on or off, so that the motor of the first drive section can be used for movement downhole while the second drive section is inoperative, and vice versa. The hydraulic system in the tractor supplies the chamber in the distributor assembly 12—with high pressure hydraulic fluid for operating the wheel 4.

In other variants, the position of the ports 17 can be changed from the first to the second position when the tractor is deployed in the well. In such variants, the distributor assembly 12 can be implemented where the distributor sleeve is coupled to the boss 10 so that it can be rotated to different positions with respect to the boss 10 (and the cam profile 31) by remote actuation, e.g. hydraulically or by electric control. This can allow switching of the distributor sleeve 16 between different rotational orientations while the tractor is deployed in a wellbore. This can avoid the need for pre-configuring the distributor assembly 12 with the sleeve 16 in one or the other position. For example, the distributor sleeve 16 may in such an embodiment have a surface to which hydraulic oil may be supplied and against which it may apply pressure to produce a component of torque to turn the distributor sleeve 16 from the first position relative to the cam to the second position. Hydraulic oil may be routed to such a member by switching a valve in the hydraulic circuit to direct fluid through a conduit to a chamber which is in communication with the surface. In such variants also, by way of changing the position of the ports when in the well, it can be appreciated that the same drive sections as previously used for downhole propulsion (in the same trip) can be used for uphole propulsion. For example, after the drive sections have been engaged in downhole propulsion in the well, the distributor sleeves 16 in those drive sections are moved and set in their second positions while the tractor remains in the well, e.g. by hydraulic or electric actuation, to reverse their directions of rotation. The drive sections are thereafter operated to provide uphole propulsion of the tractor. Since the drive sections can be used for downhole and then, once ports are switched, uphole propulsion, the total number of drive sections needed in the tractor may be reduced. All sections can be active in both uphole and downhole propulsion phases, and inclusion of redundant passive sections can be avoided. In turn, this can allow savings to be made in the overall length of the tractor.

While the above described example utilizes eight pistons and a cam profile 31 that is wave shaped with six crests or troughs, it will be appreciated that in other embodiments the rotational assembly 20 can have fewer or a greater number of pistons 22, and the cam profile 31 can have other numbers of troughs and crests or other arrangement of inclined slopes to generate a torque on the rotatable assembly 20.

In FIGS. 8 to 14 another example of a device 101 is depicted having corresponding components to those of the embodiment of FIGS. 1 to 7. The corresponding components are referenced with the same numerals but incremented by one hundred, and the description of these are not repeated here.

The distributor assembly 112 is configured differently in this example, and instead of separate supply and extract bores 27, 29, a bi-directional in/out bore 187 is provided. The in/out bore 187 serves for communication of oil into the drive chamber 128, and, in the return phase, out of the drive chamber 128. Thus, when the piston retracts, oil is expelled from the drive chamber 128 to the drain path through the bore 187. Conversely, when the piston is being energized and extends, oil is supplied into the drive chamber 128 for energizing the piston, and the oil passes through the same bore 187.

However, the return oil does not pass into the annular chamber 158 that contains high pressure oil. Rather, it is conveyed in grooves 189 extending axially on the sleeve 116 at positions between adjacent supply ports 117. The returning oil is carried along the groove between the sleeve 116 and a body of the rotatable assembly 120 onward on the drain path through open space 148 within the enclosure of the wheel 104 and the drain conduit or line 149 in the arm 102 to low pressure hydraulic tank. The bore 187 communicates with the grooves 189 in the same positions as the notches 19 in the embodiment of FIGS. 1 to 7.

In FIGS. 15 to 21, another example of a device 201 is depicted having corresponding components to those of the embodiment of FIGS. 1 to 7. The corresponding components are referenced with the same numerals but incremented by two hundred, and the description of these are not repeated here.

The general operation of the device 201 is similar to that of the embodiments described above, although the rotatable assembly 220 in this example has an annular body portion which fits inside the distributor ring 286 of the distributor assembly 212. The boss 210 in this example does not form part of the distributor assembly 212. Like the embodiments of FIGS. 1 to 14 above however, both the distributor ring 286 and the cam ring 230 are concentrically arranged around the axis of rotation X of the rotatable assembly 220.

In this example, oil is supplied from the ports 217 inwardly toward the centre of the distributor ring 286. An in/out bore 227 in the piston housing is connected to the ports 217 through a conduit in the annular body portion of the assembly 220 for supplying high pressure hydraulic oil to the drive chambers 228 of the pistons when they are energized. The in/out bore 227 is bi-directional such that return fluid to be expelled from the drive chamber in the retraction cycle also passes through the in/out bore 227 and the conduit in the annular body portion. However, in the rotational position at which the retraction of the piston 222 takes place (due to interaction with the cam profile 231), the bore 227 is in communication with axial recesses 219 in an inside face of the distributor ring 286. The return oil can then pass along the recesses on the drain path through the drain line or conduit 249 to hydraulic low-pressure tank.

It can be appreciated that the distributor ring 286 and piston housings 225 can be embodied in other ways. For example, the piston housings 225 may have unidirectional supply and extract bores for bringing hydraulic oil in and out of the drive chamber 228. The distributor ring 286 may be adapted accordingly with notches, ports or other formations for allowing the hydraulic oil to exit from the assembly 220 and be conveyed in a micro space between the distributor ring 286 and the annular body of the rotational assembly 220 on the drain path.

The hydraulic distributor assembly 212 has in this example an outer part in the form of a circumferential wall 284 of the arm 202, and an inner part in the form of the distributor ring 286. The annular chamber 258 is defined between the wall 284 and the distributor ring 286, extending around an outside of the distributor ring 286. Annular seals 259*a*, 259*b* are provided for delimiting the chamber 258 to the annular region formed therebetween. The chamber 258 is supplied with high pressure hydraulic oil through a supply conduit 208 in the arm 202. As in the embodiments of FIGS. 1 to 14 above, the distributor ring 286 is rotatable about the axis X to place the ports 217 in different positions circumferentially relative to the cam ring 230, so as to provide forward, clockwise rotation of the rotatable assembly 220 in one position and reverse, anti-clockwise rotation in another position. The distributor ring 286 is fixed to the arm 202 in the selected position, for either reverse or forward rotation, by screws. In configuring the motor 203 for operation, the screws 295 are removed to release the distributor ring 286 and the distributor ring 286 is rotated to the other position where it is again fixed to the body 205 by the screws 295. The rotatable assembly is put in place, so as to be rotatable about the boss 210, and the device other-wise prepared for operation. Hydraulic oil is supplied to the chamber 258 for driving rotation for operating the motor 203.

For performing operations in a wellbore such as a well intervention, a tool string coupled to a wireline is prepared and includes multiple tractor sections each carrying a motor 3, 103, 203 for driving a wheel on an extractable end of an arm 2, 102, 202. In at least one of the tractor sections, i.e. drive sections, the oil distributor assembly 12, 112, 212 has the high-pressure supply ports 17, 117, 217 set in a first position relative to the cam profile that can produce rotation in a forward direction. In at least one other tractor section, the oil distributor assembly 12, 112, 212 has the high-pressure supply ports 17, 117, 217 set in a second position relative to the cam profile that can produce rotation in a forward direction. The forward rotation section(s) may be separately selected for driving the tractor downhole, and the reverse rotation section(s) may be selected for driving the tractor uphole.

The couplings 105, 205 can also be configured like the coupling 5 in FIG. 1. In this way, the wheel 5 can be coupled to the rotatable assembly through a planetary gear arrangement.

Various modifications and improvements may be made without departing from the scope of the invention herein described.

The invention claimed is:

1. A wireline tractor comprising at least one drive wheel and at least one device for hydraulically operating the drive wheel, which device comprises:

at least one cam;

a distributor; and a rotatable assembly arranged to be rotatable with respect to the at least one cam and the distributor about an axis of rotation, the assembly comprising at least one piston;

the distributor comprising:

an inner part;

an outer part arranged around the inner part; and a chamber between the inner and outer parts;

either the inner part or the outer part comprising at least one supply port for supplying hydraulic fluid therethrough from the chamber to the at least one piston for energizing the at least one piston, the at least one supply port being arranged to be moved between first and second positions relative to the at least one cam;

wherein, in the first position, the at least one piston can connect to the at least one supply port and be energized to impart force against the at least one cam for producing forward rotation of the rotatable assembly, and in the second position, the at least one piston can connect to the at least one supply port and be energized to impart force against the cam for producing reverse rotation of the rotatable assembly.

2. The wireline tractor as claimed in claim 1, further comprising a coupling for transmitting rotation to the drive wheel in correspondence with the reverse or forward rotation of the rotatable assembly.

3. The wireline tractor as claimed in claim 1, further comprising a gear arrangement for coupling the drive wheel to the rotatable assembly.

4. The wireline tractor as claimed in claim 3, wherein the gear arrangement comprises an inner sun gear attached to the rotatable assembly, an outer ring gear attached to the wheel and planet gears arranged between the sun gear and a ring gear.

5. The wireline tractor as claimed in claim 1, wherein the drive wheel defines an enclosure for containing return hydraulic fluid from the at least one piston therewithin, and a drain path for communicating the return hydraulic fluid through open space in the enclosure to a low pressure tank.

6. The wireline tractor as claimed in claim 1, wherein the rotatable assembly comprises a plurality of pistons and either the inner part or the outer part of the distributor further comprises a plurality of supply ports for supplying hydraulic fluid from the chamber to the plurality of pistons of the rotatable assembly.

7. The wireline tractor as claimed in claim 1, wherein either or both of the outer and inner parts of the distributor are in the form of a ring or a sleeve.

8. The wireline tractor as claimed in claim 7, wherein the at least one supply ports are radial ports extending through a wall of the sleeve or ring.

9. The wireline tractor as claimed in claim 7, wherein the at least one supply ports are spaced apart circumferentially around the sleeve or ring.

10. The wireline tractor as claimed in claim 1, wherein the chamber comprises an annular chamber.

11. The wireline tractor as claimed in claim 1, wherein the at least one piston is operable to extend linearly and radially away from the axis of rotation.

12. The wireline tractor as claimed in claim 1, wherein the rotatable assembly is supported on a supporting structure.

13. The wireline tractor as claimed in claim 12, wherein the supporting structure of the device comprises an annular space for receiving the rotatable assembly.

14. The wireline tractor as claimed in claim 13, wherein the rotatable assembly has a generally annular shape.

15. The wireline tractor as claimed in claim 1, wherein the at least one cam comprises a wave profile extending circumferentially around the rotatable assembly.

16. The wireline tractor as claimed in claim 15, wherein the wave profile comprises six crests and six troughs.

17. The wireline tractor as claimed in claim 1, wherein in the first position, the at least one piston is energized with linear extension to impart force against at least one first surface section of the at least one cam which is inclined with respect to a direction of linear extension of the at least one piston for producing the forward rotation.

18. The wireline tractor as claimed in claim 17, wherein in the second position, the at least one piston is energized with linear extension to impart force against at least one second surface section of the at least one cam which is inclined with respect to a direction of linear extension of the piston in an opposite sense to the incline of the at least one first surface section, for producing the reverse rotation.

19. The wireline tractor as claimed in claim 1, wherein the device is a hydraulic radial piston motor.

20. The wireline tractor as claimed in claim 1, wherein the device further comprises a formation about which the rotatable assembly is rotatable, wherein the formation comprises the distributor.

21. The wireline tractor as claimed in claim 1, wherein the axis of rotation extends through the rotatable assembly.

22. The wireline tractor as claimed in claim 1, wherein the device is provided in an extractable arm of the wellbore tractor.

23. The wireline tractor as claimed in claim 1, wherein the rotatable assembly of the device is coupled to the drive wheel to produce forward or reverse rotation of the drive wheel in dependence upon the rotation of the rotatable assembly.

24. The wireline tractor as claimed in claim 1, including at least one tractor section located in a wellbore string, the at least one tractor section includes a drive wheel mounted on an end of an arm which is extractable from a body of the tractor section, the device configured to operate the drive wheel.

25. The wireline tractor as claimed in claim 24, including a plurality of tractor sections respectively including at least one drive wheel mounted on an end of an arm which is extractable from a body of the tractor section, wherein at least one of the tractor sections includes the device in which the at least one port is set in the first position for operating a corresponding drive wheel in a forward direction, and at least one other of the tractor sections includes the device in which the at least one port is set in the second position for operating another corresponding drive wheel in a reverse direction.

26. The wireline tractor as claimed in claim 24, wherein the wellbore string is configured to be coupled to a wireline.

27. The wireline tractor as claimed in claim 25 wherein the wellbore string includes at least one well intervention tool.

28. A wireline tractor arm including a distributor for distributing hydraulic fluid in a device for operating a drive wheel of a wellbore tractor, the device comprising at least one cam and a rotatable assembly rotatable about an axis of rotation relative to the cam, the distributor comprising:

an inner part;

an outer part arranged around the inner part; and a chamber between the inner and outer parts;

either the inner part or the outer part comprising at least one supply port for transmitting hydraulic fluid therethrough from the chamber to a connected piston of the rotatable assembly for energizing the piston;

wherein the inner or outer part is movable with respect to an other of the inner and outer parts between first and second positions, for forward rotation of the rotatable assembly when in the first position and reverse rotation of the rotatable assembly when in the second position.

29. The wireline tractor arm as claimed in claim 28, wherein the outer part is lockable to obtain a fixed relationship with respect to the inner part in either the first or the second position.

30. The wireline tractor arm as claimed in claim 29, which wherein the distributor further comprises a locking device for locking the inner part in fixed relationship with respect to the outer part in the first or second position.

31. The wireline tractor arm as claimed in claim 30, wherein the locking device comprises a locking ring and a fastener for fastening the locking ring to either the inner or outer part, so that the locking ring prevents relative movement between the inner and outer parts.

32. The wireline tractor arm as claimed in claim 28, wherein the outer part comprises a ring or sleeve around the inner part.

33. The wireline tractor arm as claimed in claim 28, wherein the outer part is slidably disposed around the inner part for slidably rotating the outer part circumferentially around the inner part between the first and second positions.

34. The wireline tractor arm as claimed in claim 28, wherein the distributor further comprises a pair of seals extending around the inner part, the annular chamber being defined between the seals, the supply ports comprising an opening through a wall of the outer part for communicating with the chamber.

35. The wireline tractor arm as claimed in claim 28, wherein the outer part is arranged to be releasable from locked configuration with an inner part of a hand of a user.

36. The wireline tractor arm as claimed in claim 35, wherein the outer part is arranged to be rotatably movable from the first position to the second position relative to the inner part by the user's hand.

37. The wireline tractor arm as claimed in claim 28, wherein the one part that comprises the ports includes at least one formation for defining a drain path away for fluid expelled from the at least one piston in part of a rotation cycle of the rotatable assembly.

38. The wireline tractor arm as claimed in claim 37, wherein the formation comprises a groove or notch for providing a flow conduit for draining fluid between the assembly and the part.

39. A method of operating a tractor in a wellbore, the tractor having at least one section comprising at least one drive wheel mounted on an end of an arm, the arm being extractable from a body of the section, and the arm including a device comprising at least one cam; a distributor; and a rotatable assembly arranged to be rotatable with respect to the at least one cam and the distributor about an axis of rotation, the rotatable assembly comprising at least one piston; the distributor comprising: an inner part; an outer part arranged around the inner part; and a chamber between the inner and outer parts; either the inner part or the outer part comprising at least one supply port for supplying hydraulic fluid therethrough from the chamber to the at least one piston for energizing the at least one piston, the at least one supply port being arranged to be moved between first and second positions relative to the at least one cam; wherein, in the first position, the at least one piston connects to the at least one supply port and be energized to impart force against the at least one cam for producing forward rotation of the rotatable assembly, and in the second position, the at least one piston connects to the at least one supply port and be energized to impart force against the cam for producing reverse rotation of the rotatable assembly, the method comprising the steps of:

extracting the arm to push the drive wheel against a surrounding wall of the wellbore;

supplying hydraulic fluid to the chamber of the device to generate rotation of the tractor wheel in either the forward or reverse direction corresponding to the position of the port or ports, the hydraulic fluid supplied to the chamber through the arm.

40. A method of configuring a wellbore tractor, the tractor having at least one section which comprises at least one device, comprising at least one cam; a distributor; and a rotatable assembly arranged to be rotatable with respect to the at least one cam and the distributor about an axis of rotation, the assembly comprising at least one piston; the distributor comprising: an inner part; an outer part arranged around the inner part; and a chamber between the inner and outer parts; either the inner part or the outer part comprising at least one supply port for supplying hydraulic fluid therethrough from the chamber to the at least one piston for energizing the at least one piston, the at least one supply port being arranged to be moved between first and second positions relative to the at least one cam; wherein, in the first position, the at least one piston connects to the at least one supply port and be energized to impart force against the at least one cam for producing forward rotation of the rotatable assembly, and in the second position, the at least one piston connects to the at least one supply port and be energized to impart force against the cam for producing reverse rotation of the rotatable assembly, the method comprising the step of:

moving the port between the first position and the second position to set the port in either the first position for generating forward motion of the drive wheel or the second position for generating reverse motion of the drive wheel.

41. A device for hydraulically operating a drive wheel of a wellbore tractor, the device comprising:

at least one cam;

a distributor;

a rotatable assembly arranged to be rotatable with respect to the at least one cam and the distributor about an axis of rotation, the assembly comprising at least one piston;

the distributor comprising:

an inner part;

an outer part arranged around the inner part; and a chamber between the inner and outer parts;

either the inner part or the outer part comprising at least one supply port for supplying hydraulic fluid therethrough from the chamber to the at least one piston for energizing the at least one piston, the supply port being arranged to be moved between first and second positions relative to the cam;

wherein, in the first position, the at least one piston can connect to the at least one supply port and be energized to impart force against the at least one cam for producing forward rotation of the rotatable assembly, and in the second position, the at least one piston can connect to the at least one supply port and be energized to impart force against the cam for producing reverse rotation of the rotatable assembly;

a coupling for transmitting rotation to the drive wheel in correspondence with the reverse or forward rotation of the rotatable assembly.

42. A distributor for distributing hydraulic fluid in a device for operating a drive wheel of a wellbore tractor, the device comprising at least one cam and a rotatable assembly rotatable about an axis of rotation relative to the cam, the distributor comprising:

an inner part;

an outer part arranged around the inner part; and a chamber between the inner and outer parts;

either the inner part or the outer part comprising at least one supply port for transmitting hydraulic fluid therethrough from the chamber to a connected piston of the rotatable assembly for energizing the piston;

wherein the inner or outer part is movable with respect to an outer of the inner and outer parts between first and second positions, for forward rotation of the rotatable assembly wherein the first position and reverse rotation of the rotatable assembly when in the second position;

a locking device for locking the inner part in fixed relationship with respect to the outer part in the first or second position, wherein the locking device comprises a locking ring and a fastener for fastening the locking ring to either the inner or outer part, so that the locking ring prevents relative movement between the inner and outer parts, wherein the outer part is lockable to obtain a fixed relationship with respect to the inner part in either the first or the second position.

* * * * *